US010294005B2

(12) United States Patent
Pickard et al.

(10) Patent No.: US 10,294,005 B2
(45) Date of Patent: May 21, 2019

(54) VENTILATED CONTAINER FOR PRODUCE

(71) Applicant: ORORA PACKAGING SOLUTIONS, Buena Park, CA (US)

(72) Inventors: Keith Pickard, Ontario (CA); Charles Erway, Cadillac, MI (US)

(73) Assignee: Orora Packaging Solutions, Buena Park, CA (US)

( * ) Notice: Subject to any disclaimer, the term of this patent is extended or adjusted under 35 U.S.C. 154(b) by 308 days.

(21) Appl. No.: 15/229,023

(22) Filed: Aug. 4, 2016

(65) Prior Publication Data

US 2017/0305633 A1 Oct. 26, 2017

Related U.S. Application Data

(63) Continuation-in-part of application No. 29/562,176, filed on Apr. 22, 2016, now Pat. No. Des. 789,195,
(Continued)

(51) Int. Cl.
*B65D 1/40* (2006.01)
*B65D 43/02* (2006.01)
(Continued)

(52) U.S. Cl.
CPC ..... *B65D 81/263* (2013.01); *B65D 1/40* (2013.01); *B65D 43/0212* (2013.01); *B65D 77/2024* (2013.01); *B65D 85/34* (2013.01)

(58) Field of Classification Search
CPC ..... B65D 81/263; B65D 81/26; B65D 81/24; B65D 1/40; B65D 1/42; B65D 1/44;
(Continued)

(56) References Cited

U.S. PATENT DOCUMENTS

D195,375 S 6/1963 Bostrom
D211,682 S * 7/1968 Elcholtz et al. ..... D9/425
(Continued)

FOREIGN PATENT DOCUMENTS

JP 06-071478 10/1994
WO WO 2015/076490 5/2015

OTHER PUBLICATIONS

U.S. Appl. No. 29/562,176, filed Apr. 2016, Pickard et al.
(Continued)

*Primary Examiner* — Steven A. Reynolds
*Assistant Examiner* — Javier A Pagan
(74) *Attorney, Agent, or Firm* — Martin & Ferraro LLP

(57) ABSTRACT

A ventilated container for produce includes a bottom, sidewalls extending upwardly from the bottom, and a rim having a flattened top surface. The sidewalls include at least one ventilation opening located proximate the rim of the container thereby permitting the rim of the container to be generally flat and uninterrupted. The location of ventilation opening(s) proximate the rim of the container allows the flow of rising ethylene gas within the container to exit near the top of the container improving ventilation within the container. A plastic film can be applied over the top of the container and is adhered to the container with an adhesive to form a secure and rigid seal between the film and the container. The flattened surface of the rim improves the adherence between a film and the container to enclose and seal the container, aids the rigidity of the container, and lessens the likelihood of the edges of the rim being bent or folded when pressure is exerted to protect produce provided within the container. Moreover, an aperture on the bottom of the container provides drainage of liquid from the container and allow air to flow.

20 Claims, 50 Drawing Sheets

Related U.S. Application Data which is a continuation-in-part of application No. 29/562,181, filed on Apr. 22, 2016, now Pat. No. Des. 801,806.

(51) Int. Cl.
*B65D 81/26* (2006.01)
*B65D 77/20* (2006.01)
*B65D 85/34* (2006.01)

(58) Field of Classification Search
CPC ..... B65D 43/021; B65D 43/0204; B65D 43/0202; B65D 43/02; B65D 85/345; B65D 85/34; B65D 85/30
USPC ..... 220/785
See application file for complete search history.

(56) References Cited

U.S. PATENT DOCUMENTS

D214,832 S 8/1969 Bloch et al.
D275,886 S 10/1984 Sheward et al.
D280,590 S 9/1985 Schrage
4,616,762 A 10/1986 Alexander
D296,191 S 6/1988 Yoshida et al.
D348,394 S 7/1994 Dreyer
D370,345 S 6/1996 Wolff
D378,039 S 2/1997 Ferris
D378,552 S * 3/1997 Lippisch ..... D3/273
D395,756 S 7/1998 Tanji
D398,151 S 9/1998 Ahern, Jr.
D415,935 S * 11/1999 Martinez ..... D7/602
D429,965 S 8/2000 Hayes et al.
D485,473 S * 1/2004 Dais ..... D7/629
D492,844 S 7/2004 Ramirez et al.
D496,272 S * 9/2004 Jackson ..... D7/602
D502,096 S * 2/2005 Wilcock ..... D9/425
D514,441 S * 2/2006 Snedden ..... D9/418
D514,514 S * 2/2006 Franks, Jr. ..... D13/133
D514,931 S 2/2006 Snedden et al.
D558,045 S * 12/2007 Templeton ..... D9/420
D562,128 S * 2/2008 van de Velde ..... D9/420
D579,767 S 11/2008 Wallach
D586,652 S 2/2009 Wallach
D591,510 S 5/2009 Auer et al.
D596,857 S 7/2009 Ahlgrim et al.
D606,811 S 12/2009 Furlong
D606,812 S 12/2009 Wu
D648,535 S 11/2011 Reinhart et al.
D649,033 S 11/2011 Epstein
D656,369 S * 3/2012 Everson ..... B65D 43/162 D7/629
D678,050 S * 3/2013 Birchmeier ..... D9/424
D685,628 S 7/2013 Durdon et al.
D689,363 S 9/2013 Sundy et al.
D692,748 S * 11/2013 Short ..... D9/420
D696,057 S 12/2013 Green et al.
D696,111 S * 12/2013 Sundy ..... D9/429
D696,938 S 1/2014 BeVier et al.
8,777,043 B2 7/2014 Furlong
8,794,440 B2 8/2014 BeVier et al.
D719,019 S 12/2014 Avis
D730,127 S 5/2015 Maxwell et al.
D772,059 S 11/2016 Urushidani et al.
2004/0118737 A1* 6/2004 Welsh ..... B65D 21/0222 206/508
2008/0135556 A1* 6/2008 Bontrager ..... B65D 1/34 220/260
2009/0120937 A1* 5/2009 Vovan ..... B65D 43/0206 220/266
2011/0272318 A1 11/2011 Gallop et al.
2012/0006842 A1* 1/2012 Overgaag ..... B65D 21/022 220/810
2013/0015096 A1 1/2013 BeVier et al.
2015/0157534 A1 6/2015 Van Puijenbroek et al.

OTHER PUBLICATIONS

U.S. Appl. No. 29/562,181, filed Apr. 2016, Pickard et al.
International Search Report and Written Opinion for PCT/US2017/024023 dated Jun. 26, 2017, 14 pgs.
International Preliminary Report of Patentability for PCT/US2017/024023 dated Oct. 23, 2018, 10 pages.

* cited by examiner

VENTILATED CONTAINER FOR PRODUCE

CROSS-REFERENCE TO RELATED APPLICATIONS

The present application is a continuation-in-part of U.S. Design application Ser. Nos. 29/562,176 and 29/562,181, filed Apr. 22, 2016 (now pending); all of which are incorporated by reference herein.

BACKGROUND

The present invention is generally directed to a container for storing and transporting produce, such as for example fruits and vegetables, efficiently and safely with improved ventilation.

For delicate produce, especially fruits and vegetables, an appropriate packaging is an important consideration in order to enable shipping from growers and processors to consumers, facilitate storage during distribution, and prolong shelf life. Many fruits and vegetables, including for example tomatoes, naturally produce ethylene gas when ripening. To prevent premature ripening, it is important to minimize exposure to ethylene gas. It only takes a few days of exposure to ethylene gas for fruits and vegetables to become overripe and inedible. This naturally occurring maturation process results in significant losses to both growers, processors, retailers, and consumers.

Conventional produce containers lack proper ventilation for ethylene gas released by the produce within such containers. Attempts have been made in the past to provide ventilation in produce containers by providing indentations in the rim of the container known as castellation. The indentations form air channels to the exterior of the container when a plastic film cover or lid is applied to the rim to close the container. However, the plastic film cover or lid applied to the rim can come loose from the rim due to the interruptions in the seal by the indentations in the rim resulting in the unintended opening of the container. Furthermore, the indentations in the perimeter of the rim create weak spots on the container. Such weak spots allow the container to flex, which can cause the container to be bent or folded at the indentations in the event that the container is crushed or dropped. These bends or fold can result in the spillage of the contents of the container. The castellation is also made with straight lines creating sharp and rigid edges and such sharp and rigid edges can damage tender produce in the containers.

Therefore, there exists a need for a produce container having appropriate ventilation for the contained produce, wherein the container can be securely sealed with a film cover or lid.

SUMMARY OF THE INVENTION

A ventilated container for produce according to an embodiment of the present invention includes a bottom, sidewalls extending upwardly from the bottom, and a rim having a flattened top surface. At least one of the sidewalls preferably includes at least one ventilation opening located proximate the rim of the container thereby permitting the rim of the container to be generally flat and uninterrupted. As discussed below, the at least one ventilation opening is provided through a surface of an indentation formed on at least one of the sidewalls that extends into the interior cavity of the container. Furthermore, the surface of the indentation through which the ventilation opening is located below the top surface of the rim.

The location of ventilation opening(s) proximate the rim of the container allows the flow of rising ethylene gas within the container to exit near the top of the container improving ventilation within the container. Furthermore, the location of the ventilation opening(s) on the interior of the container and below the top surface of the rim effectively hides the openings from consumers.

The ventilated container for produce can be enclosed with a plastic film secured to the rim to form a seal. The film is applied over the top of the container and is preferably adhered to the container with an adhesive to form a secure and rigid seal between the film and the container. The film can be made of a clear material which enables consumers to view the contents of the container when it is on display.

The ventilated container for produce of the present invention preferably does not include any indentation or interruption of the rim to provide a flattened top surface of the rim. The flattened surface of the rim improves the adherence between a film and the container to enclose and seal the container. Furthermore, the flattened surface of the rim aids the rigidity of the container, and lessens the likelihood of the edges of the rim being bent or folded when pressure is exerted to protect produce provided within the container. The uninterrupted flattened top surface also increases the seal integrity on the rim and limits the ability to of the rim to flex, thereby enabling the produce container to pass drop test done by top retailers.

As discussed above, the sidewalls can include indentations extending inwardly of the sidewalls. The surfaces of the indentation can have soft geometrical edges (such as scallops) to limit potential damage to the produce provided in the container. The indentations can have corresponding concave, square, and other configurations suitable for their intended purpose. The degree of indentation of the indentations can vary such that different sizes and shapes of produce can be suitably stored in the container.

The ventilated container for produce of the present invention facilitates the ventilation of the ethylene gas within the container by placing a ventilation opening on a sidewall below the top of the container thereby slowing the ripening process and keeping the produce fresher and longer. The ventilation opening is located on the indentations between the rim and a most of the indentations. The sidewall includes at least one, or a plurality of ventilation openings. The ventilation opening is suitably sized and configured to provide adequate ventilation suitable for the contents of the container. Different sizes and configurations of the ventilation openings are within the scope of the present invention depending on the size and shape of the container. The ventilation openings can be circular, oval, or quadrilateral, or other shapes suitable for the intended purpose.

In addition to the ventilation opening located on the sidewall, the ventilation of gas within the container can be further improved by at least one, and preferably a plurality of additional ventilation openings on the corners of the sidewalls, specifically for improved vertical venting.

An aperture on the bottom of the container provides drainage of liquid from the container and allow air to flow. At least one, and preferably a plurality of apertures on the bottom can be provided to improve the drainage. The aperture is generally circular in shape. However, the shape of the aperture may include, but is not limited to, ovals, oblongs, squares, rectangles, polygons, and other figures suitable for the intended purpose.

The shape of the ventilated container for produce can be square, rectangular, circular, elliptical, triangular, or any other figures. The length, height and width of the container can adjusted depending on the shape, size, counts and type of the produce in the container. The ventilated container is constructed of a plastic material, more specifically transparent plastic. Alternatively, the container can be made of various polymeric and monomeric plastics, paper products, and combinations of the foregoing. The ventilated container for produce is sufficiently transparent so that it is adequate for display and allows visual inspection.

BRIEF DESCRIPTION OF THE DRAWINGS

The accompanying drawings, which are included to provide further understanding of the present invention disclosed in the present disclosure and are incorporated in and constitute a part of this specification, illustrate aspects of the present invention and together with the description serve to explain the principles of the present invention. In the drawings.

DETAILED DESCRIPTION OF A PREFERRED EMBODIMENT

The detailed description set forth below is intended as a description of various configurations of the present invention and is not intended to represent the only configurations in which the present invention may be practiced. It will be apparent, however, to those of ordinary skill in the art that the present invention is not limited to the specific details set forth herein and may be practiced without these specific details.

Figure 1:
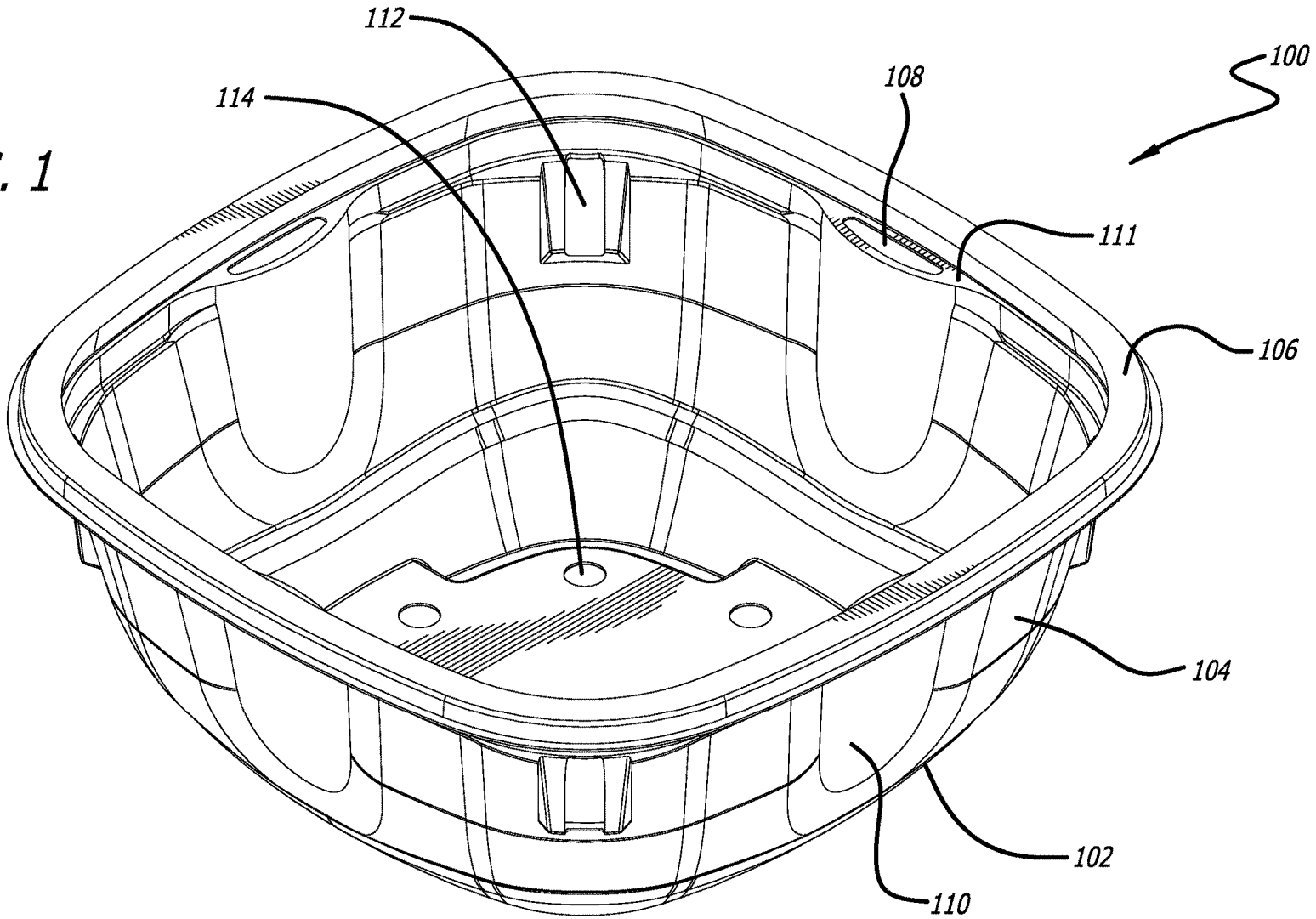
FIG. 1 is a perspective view of a container in accordance with the first embodiment of the present invention.
Figure 2:
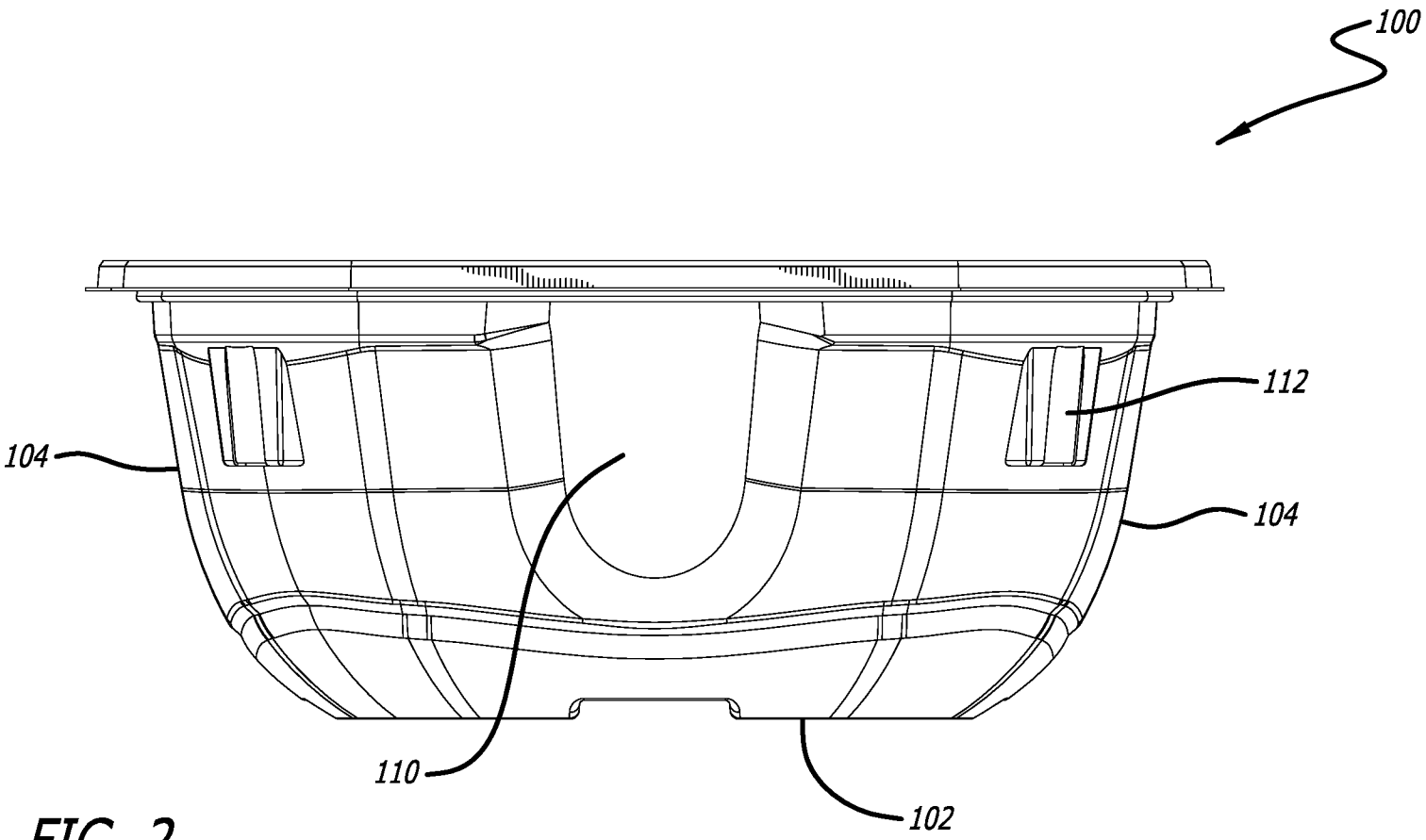
FIG. 2 is a front elevational view of the container in accordance with the first embodiment of the present invention.
Figure 3:
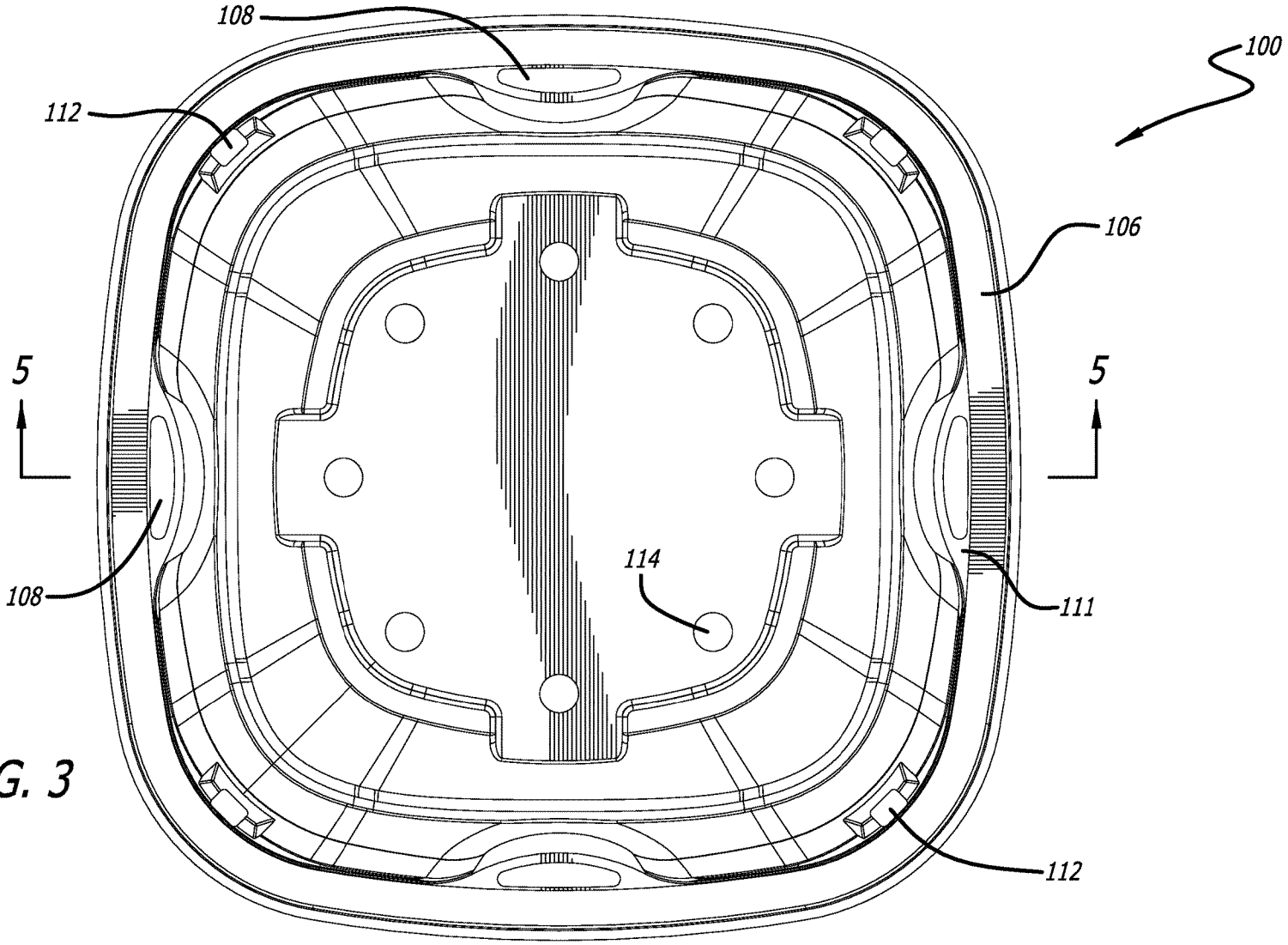
FIG. 3 is a top plan view of the container in accordance with the first embodiment of the present invention.
Figure 4:
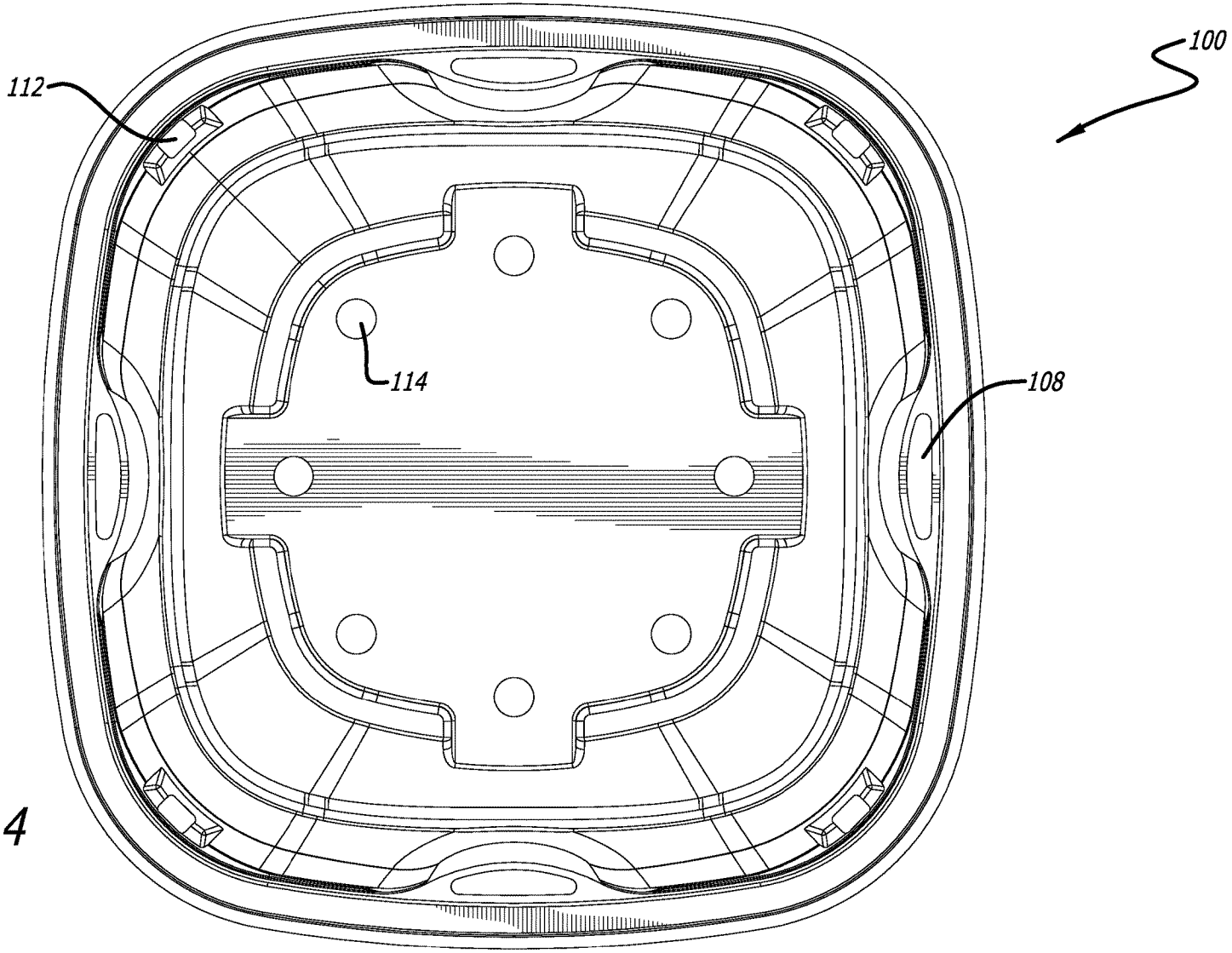
FIG. 4 is a bottom plan view of the container in accordance with the first embodiment of the present invention.

FIGS. 1-7 illustrate perspective, front, top, bottom, and cross-sectional views of container 100 in accordance with the first embodiment of the present invention. As shown in FIG. 1, in accordance with the present invention, container 100 includes a bottom 102, sidewalls 104, and a rim 106 having a flattened top surface. Sidewalls 104 extend upwardly from bottom 102, and bottom 102 and sidewalls 104 form an interior cavity of container 100. The lower portions of sidewalls 104 are attached to bottom 102 proximate the perimeter of bottom 102. At least adjacent the upper and lower portions thereof, sidewalls 104 have a complete perimeter. The upper portions of sidewalls 104 are connected to rim 106. Each of sidewalls 104 includes at least one ventilation opening 108 located proximate rim 106 of container 100.

As illustrated in FIG. 1, in a first embodiment of the present invention, rim 106 extends outwardly from the top of sidewalls 104 approximately 0.3 inches to 0.5 inches, thereby the flattened surface of rim 106 preferably has a width of approximately 0.3 inches to 0.5 inches. It is desired that rim 106 has an uninterrupted flat surface. It is understood that rim 106 need not be entirely flat as long as it is even and continuous in order to form a surface suitable for securely engaging a film or lid.

Referring to FIG. 1, sidewalls 104 include an indentation 110 extending inwardly from sidewalls 104. The top of indentation 110 preferably includes a surface 111 including ventilation opening 108. Surface 111 of indentation 110 is oriented away from bottom 102, is disposed inwardly relative to rim 104, and is positioned below rim 106. In the first embodiment, indentation 110 has a roughly concave configuration extending inwardly of sidewall 104. It is understood that indentation 110 can be, but is not limited to, concave, square, and other shapes suitable for being in contact with produce within container 110. The degree of indentation or the height of indentation 110 can vary such that each ventilation opening can has a different size and shape.

Ventilation opening 108 is formed in upper portions of sidewall 104 proximate rim 106. The location of ventilation opening 108 proximate rim 106 of the container allows the flow of rising ethylene gas within container 100 to exit near the top of container 100 improving ventilation within container 100. In the first embodiment, ventilation opening 108 has a length of approximately 1.0 inch and width of approximately 0.2 inches, but it is understood that other sizes and configurations of the ventilation openings are within the scope of the present invention depending on the size and shape of the container. For example, the ventilation openings can be circular, oval, or quadrilateral, or other shapes suitable for the intended purpose. Each of sidewalls 104 includes at least one, or a plurality of ventilation openings. It is also appreciated that at least one, but not all, of the sidewalls include at least one ventilation opening to permit the desired ventilation of gas from within the container.

Ventilation opening 108 depicted in FIGS. 1-7 has a quarter moon shape, but it may have, but is not limited to, circular, oval, or quadrilateral, shapes suitable for its intended purpose.

Figure 5:
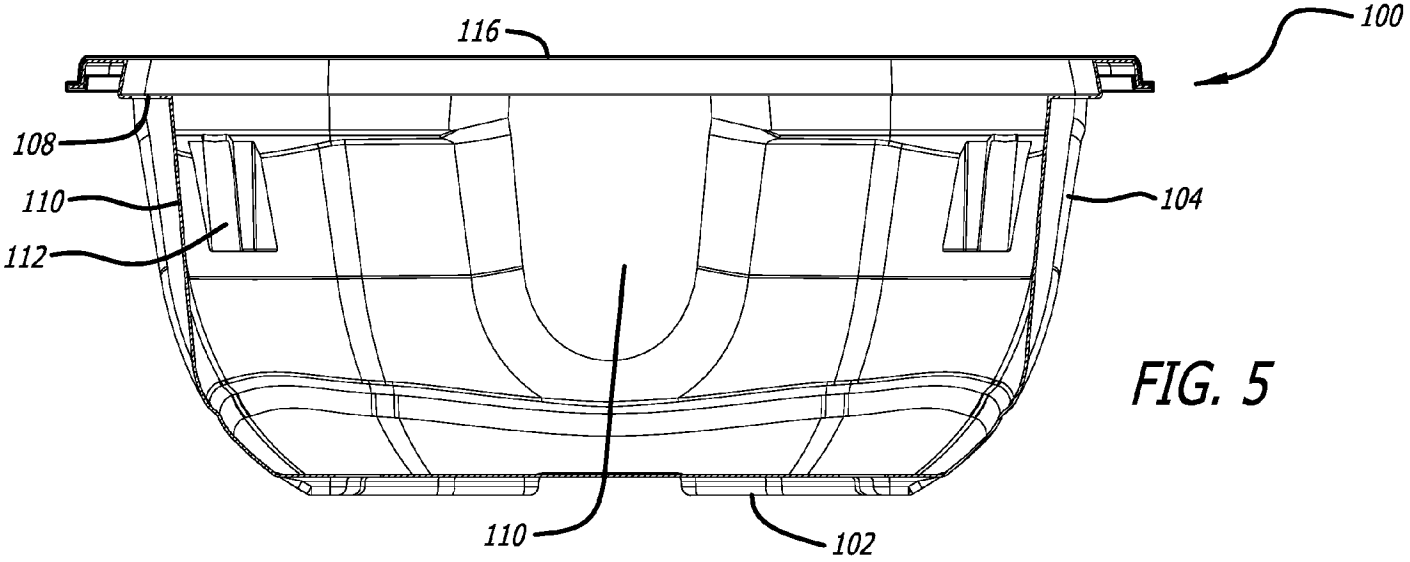
FIG. 5 is a cross-sectional view of the container taken along line 5-5 of the first embodiment of the present invention of FIG. 3, showing the enclosed container sealed with a film.
Figure 6:
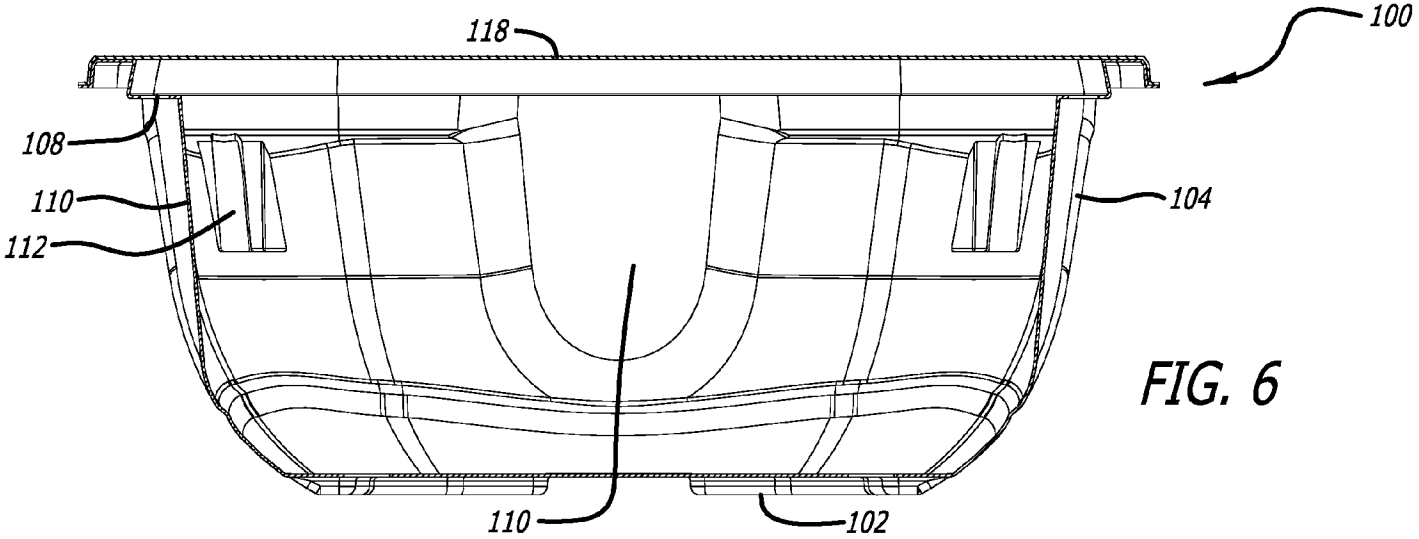
FIG. 6 is a cross-sectional view of the container taken along line 5-5 of the first embodiment of the present invention of FIG. 3, showing the enclosed container sealed with a lid.

The flattened surface of rim 106 provides a surface for a film 116 with an adhesive (as illustrated in FIG. 5) or a lid 118 (as illustrated in FIG. 6) to form an enclosed volume of container 100 for storing produce therein. The flattened surface of rim 106 allows container 100 to be more securely engaged to film 116 or lid 118. The continuous uninterrupted flattened surface of rim 106 also serves in preventing container 100 from being bent or folded when pressure is exerted on the edges of rim 106. The engagement of film 116 or lid 118 to rim 106 afforded by the flattened surface thereof also serves in better securing film 116 or lid 118 thereto. As a result, container 100 will resist damage from being crushed to better protect produce contained in container 100 and prevents produce spillage as the film stays sealed to the container. A conventional container having an indentation on a rim is malleable and can flex at the indentation when struck, which causes the produce to become bruised or even causes the film to be peeled off easily.

FIG. 5 illustrates the enclosed container 100 peripherally sealed with film 116. Container 100 is enclosed with film 116 adhered around rim 106 to form a seal. The film material may be derived from any material with properties that facilitate the enclosing of the ventilated container for use with food products. Preferably, film 116 is made of a clear material, which enables consumers to view the contents of the container when it is on display. Suitable film materials include polyethylene, polyethylene-coated cellophane, and propylene.

Similarly, as illustrated in FIG. 6, container 100 can be enclosed with lid 118. When container 100 is secured with either film 116 or lid 118, ventilation opening 108 is not blocked, which still allows gas released by produce stored in container 100 to escape through ventilation opening 108.

Figure 7:
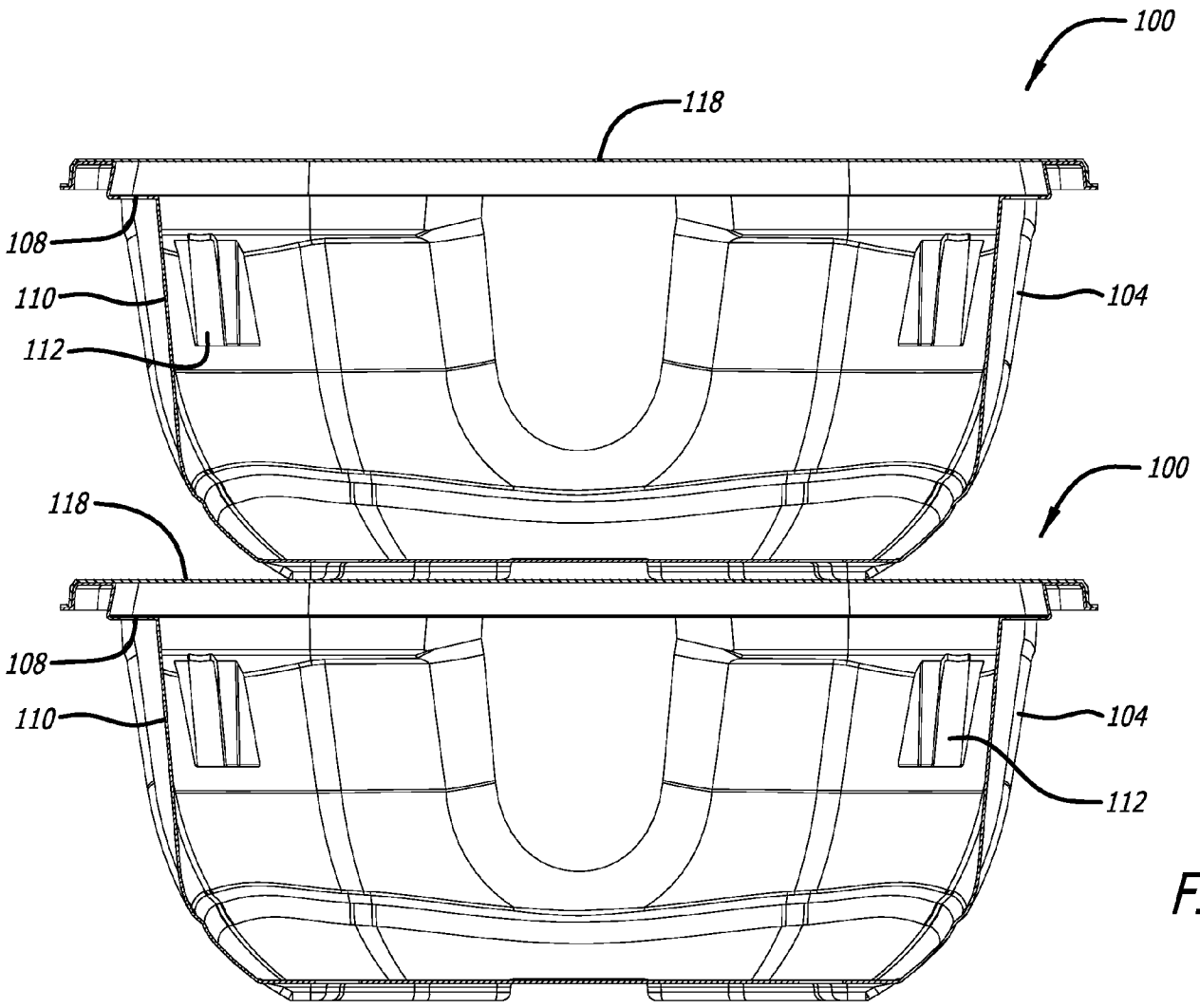
FIG. 7 illustrates a stack of two enclosed containers in accordance with the first embodiment of the present invention.
Figure 8:
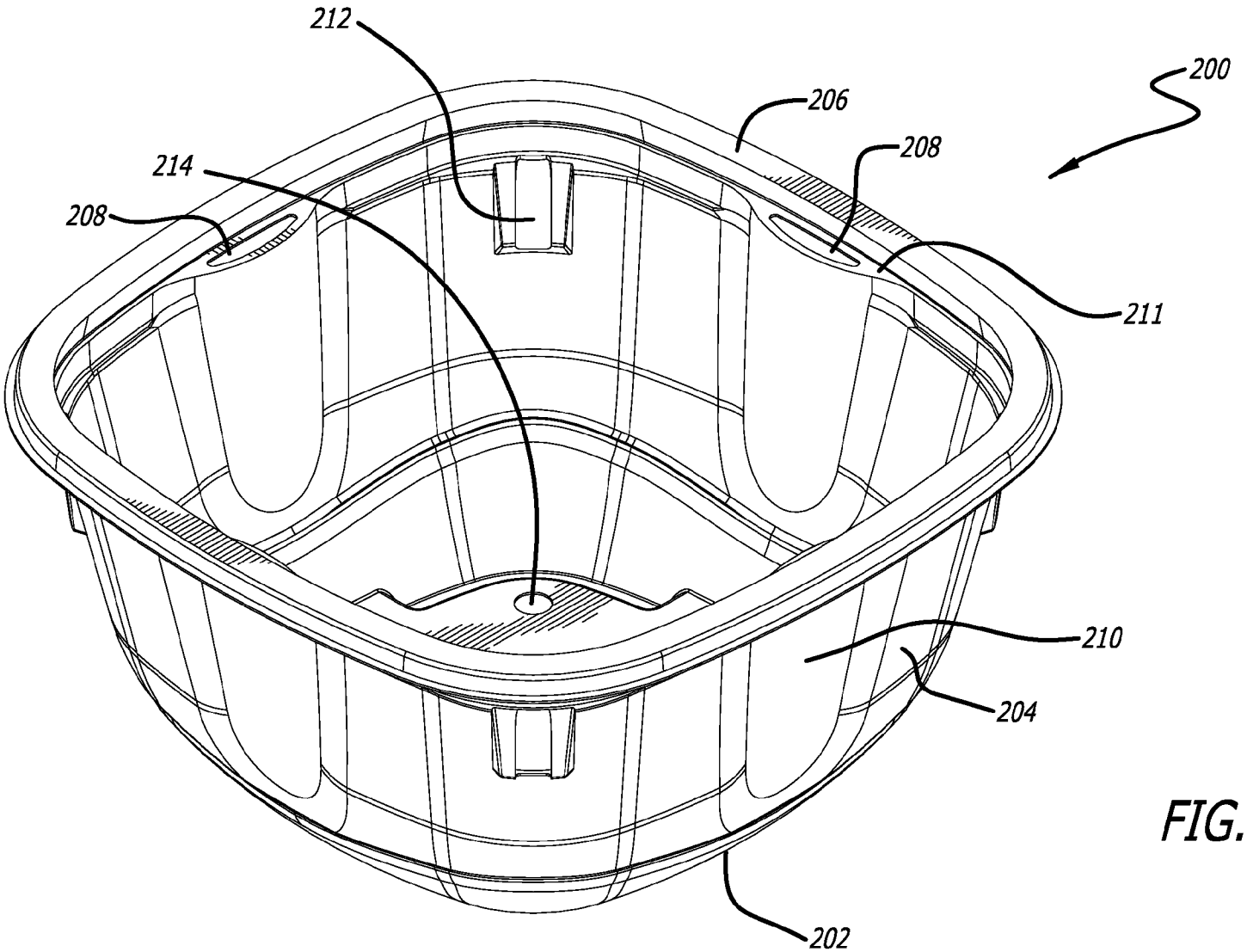
FIG. 8 is a perspective view of the container in accordance with a second embodiment of the present invention.
Figure 9:
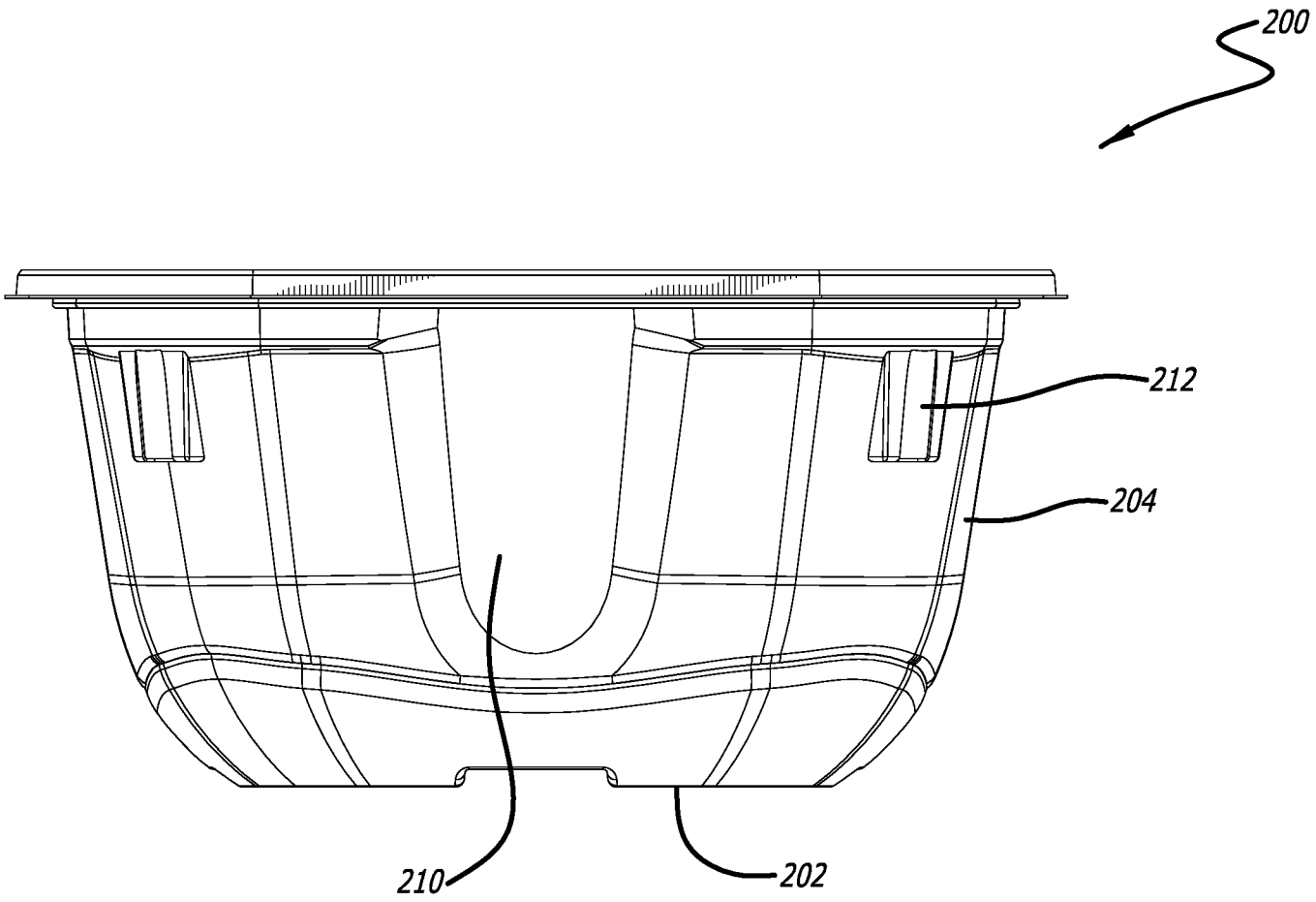
FIG. 9 is a front elevational view of the container in accordance with the second embodiment of the present invention.
Figure 10:
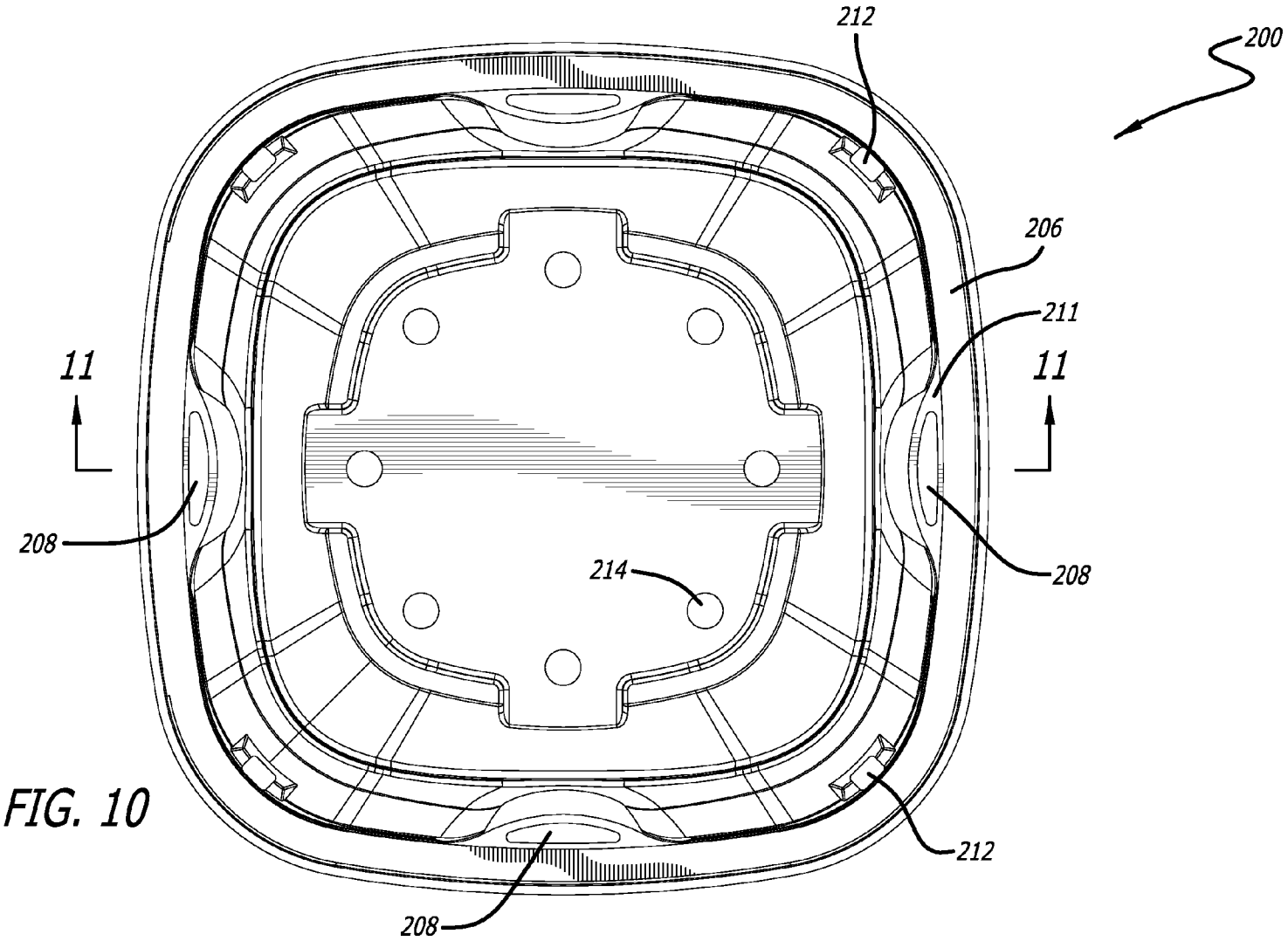
FIG. 10 is a top plan view of the container in accordance with the second embodiment of the present invention.
Figure 11:
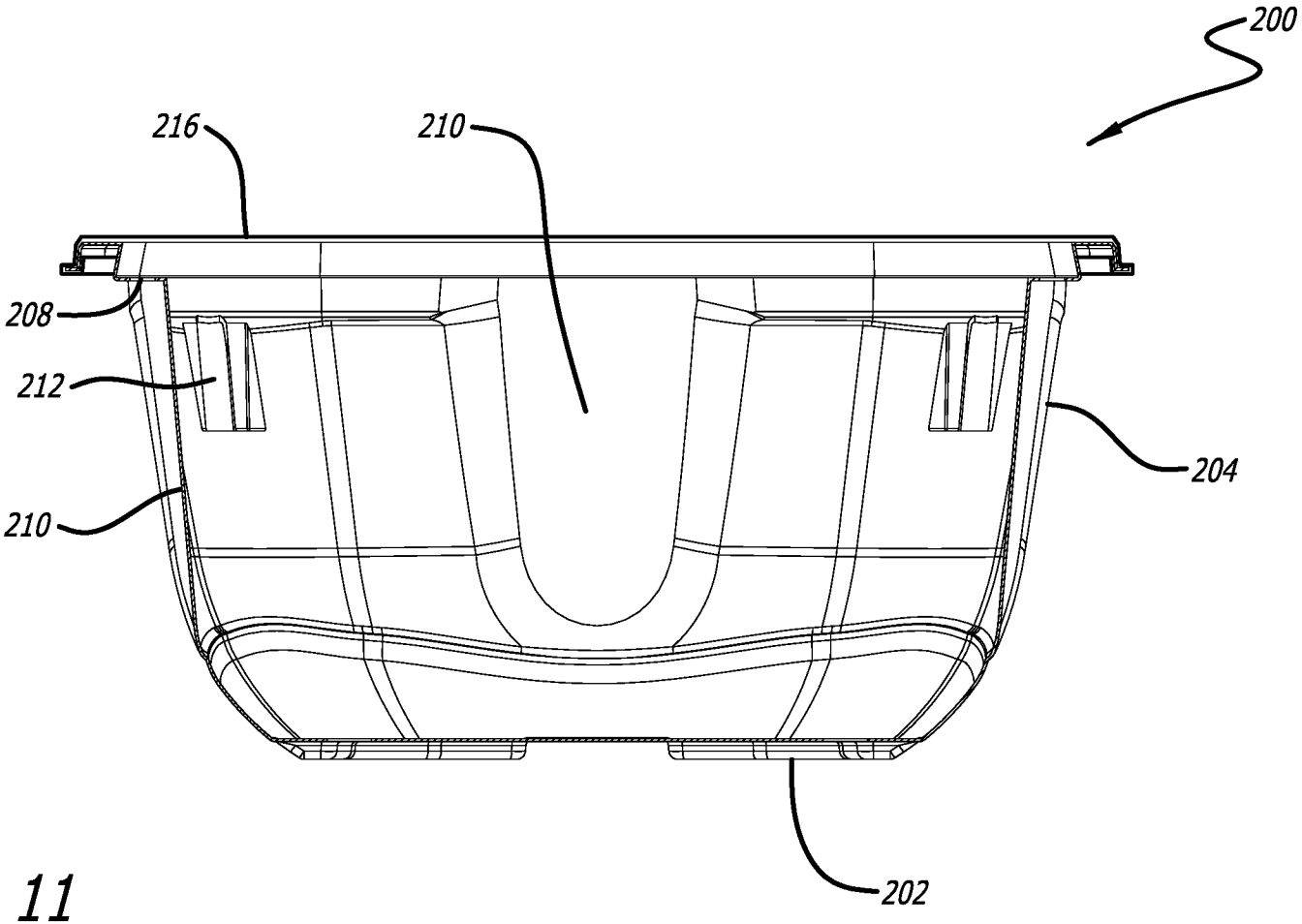
FIG. 11 is a cross-sectional view of the enclosed container sealed with a film taken along line 11-11 of the second embodiment of the present invention of FIG. 10.
Figure 12:
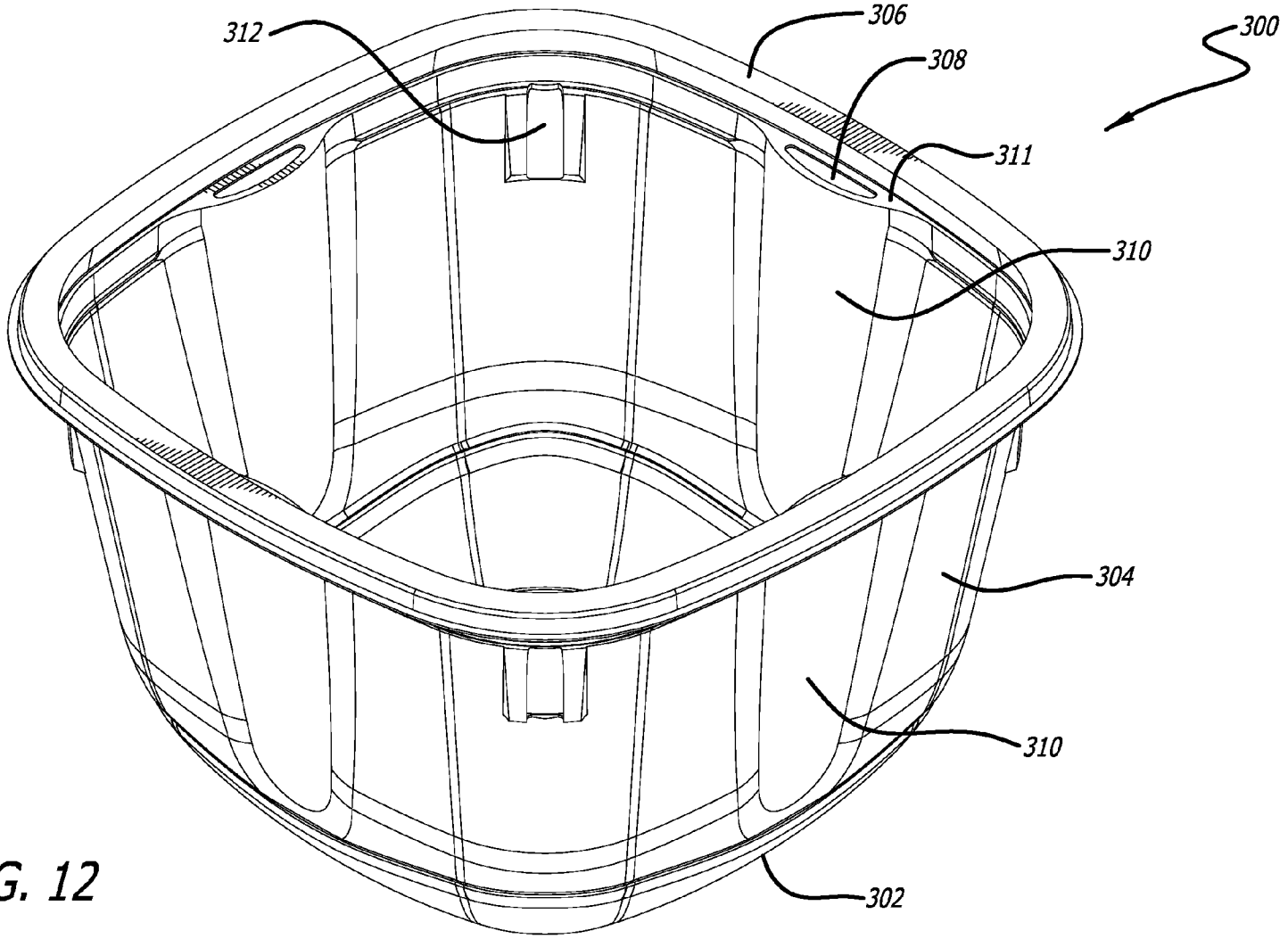
FIG. 12 is a perspective view of the container in accordance with a third embodiment of the present invention.

Furthermore, FIG. 7 illustrates two containers 100 stacked on top of each other where ventilation openings 108 are open such that the passageway for gas to exit is not blocked.

The ventilation of gas in container 100 can be further improved by at least one, and preferably a plurality of additional ventilation openings 112 on the corners of sidewalls 104, specifically for improved vertical venting.

An aperture 114 on bottom 102 of container 100 provides drainage of liquid from container 100 and allow air to flow. At least one, and preferably a plurality of apertures 114 on the bottom can be provided to improve the drainage. Aperture 114 is generally circular in shape, but it is understood that it may be in any shape suitable for its intended purpose. The shape of aperture 114 may include, but is not limited to, ovals, oblongs, squares, rectangles, polygons, and other figures suitable for the intended purpose. Aperture 114 is suitably sized, configured, and placed across bottom 102 to provide adequate drainage and ventilation for produce stored in container 100.

The first embodiment of the present invention is shown to have a generally square configuration, but is not limited to such a configuration. It is understood that the container may be made in any size suitable for its intended purpose. The shape of container 100 may be, but is not limited to, rectangular, circular, elliptical, and triangular. The length, height and width of the container can adjusted depending on the shape, size, counts and type of the produce in the container.

Container 100 is generally constructed of a plastic material, more specifically transparent plastic, such as polyethylene terephthalate (PET), polystyrene (PS), polyvinyl chloride (PVC), polylactide (PLA), crystalline polyethylene terephthalate (CPET), or polypropylene (PP). Container 100 can be sufficiently transparent so that the contents in the container is visible therethrough. While the preferred embodiment is a plastic structure, the present invention is equally applicable to alternative materials. Alternative materials include, but are not limited to, various polymeric and monomeric plastics, paper products, and combinations of the foregoing.

Reference numerals in the 200, 300, 400, 500, 600, 700, 800, 900, and 1000 series correspond, prospectively, to reference numerals in the 100 series described above in connection with ventilated container for produce 100.

As shown in FIGS. 8-11, in accordance with a second embodiment of the present invention, ventilated container for produce 200 has a generally square configuration, having a length and a width of approximately 7.5 inches and a height of approximately 2.7 inches.

Figure 13:
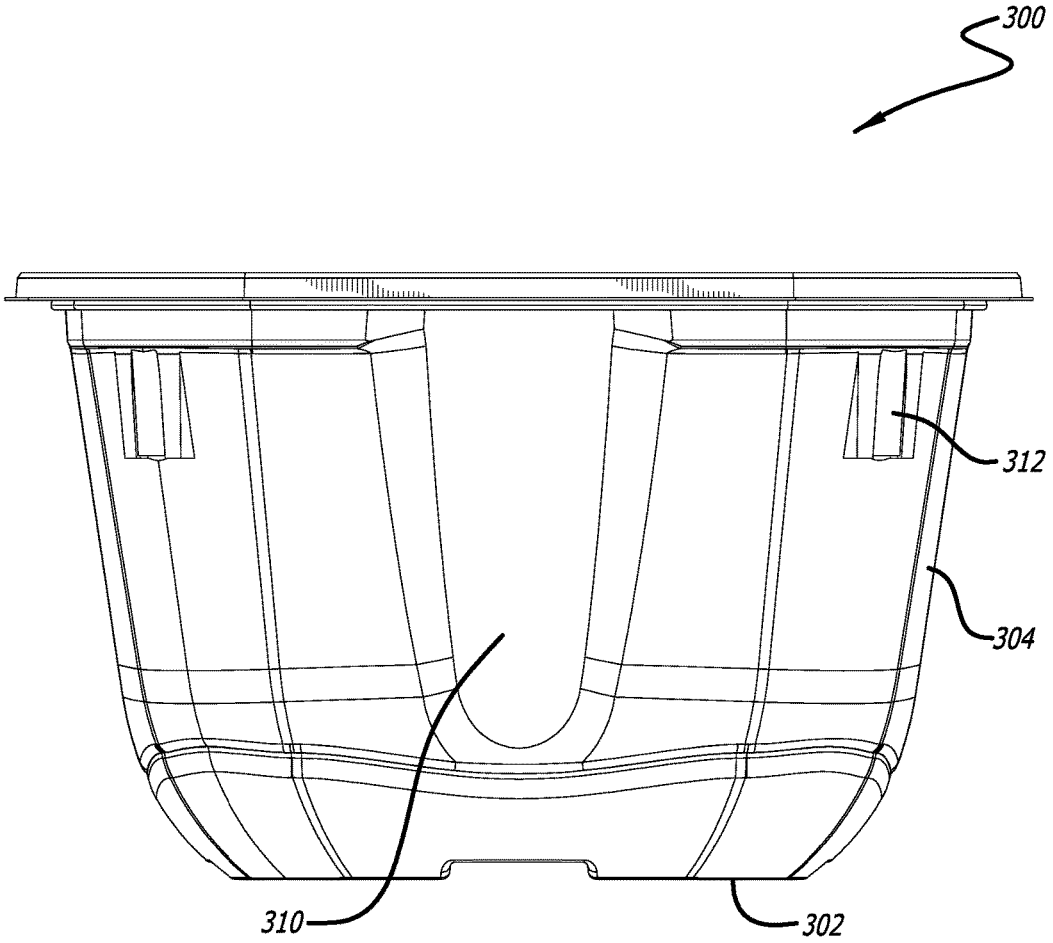
FIG. 13 is a front elevational view of the container in accordance with the third embodiment of the present invention.
Figure 14:
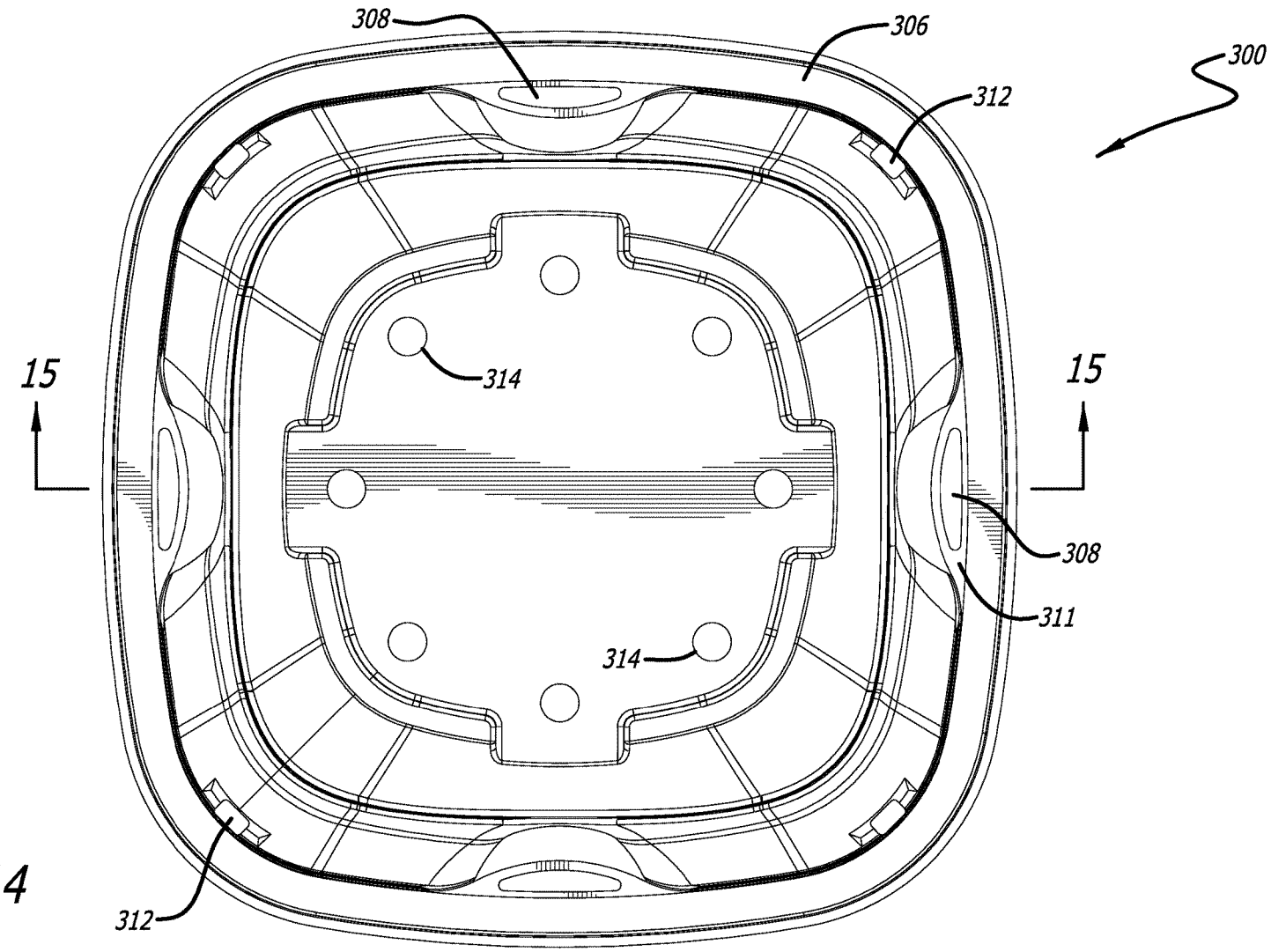
FIG. 14 is a top plan view of the container in accordance with the third embodiment of the present invention.
Figure 15:
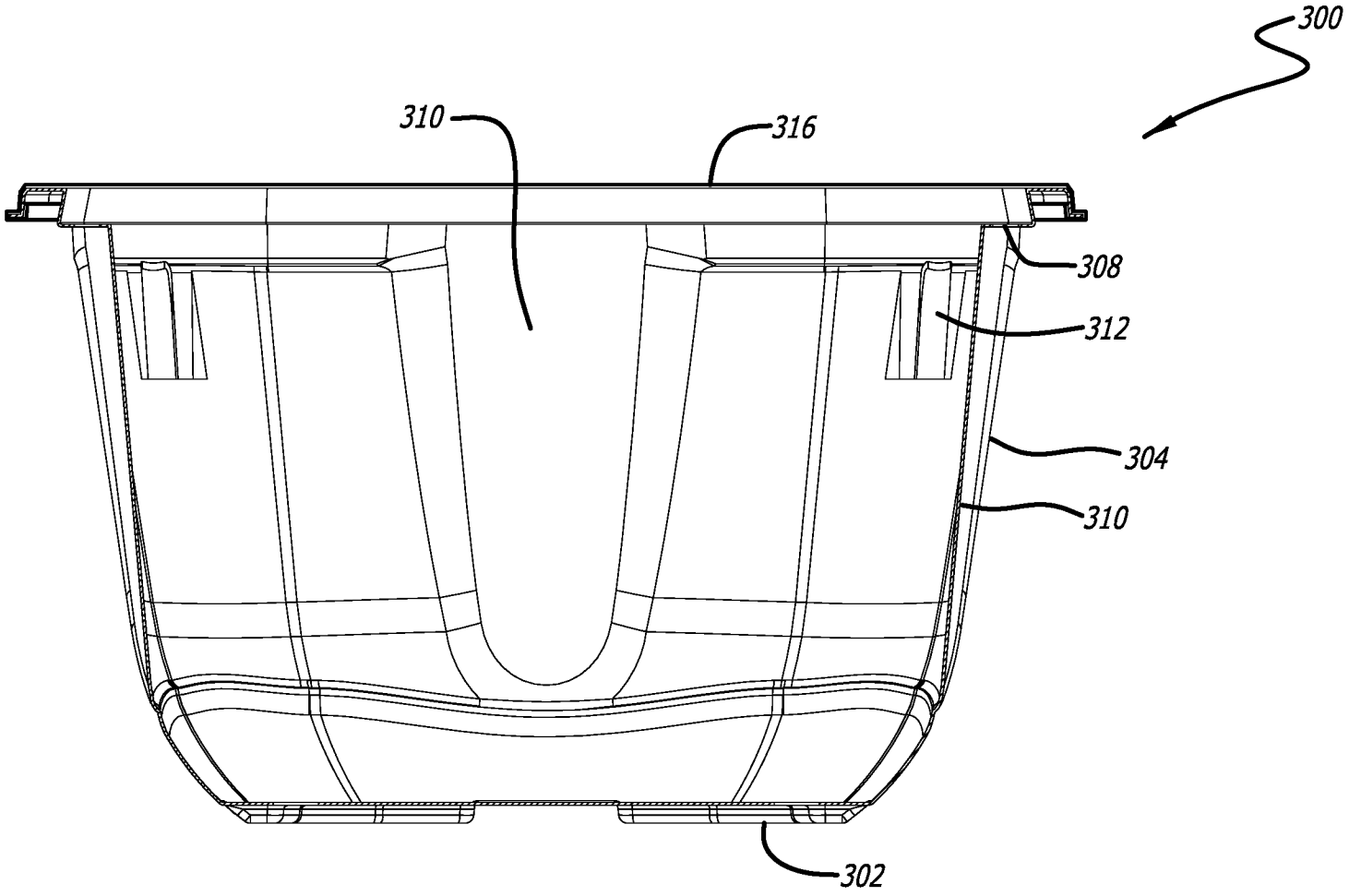
FIG. 15 is a cross-sectional view of the enclosed container sealed with a film taken along line 15-15 of the third embodiment of the present invention of FIG. 14.
Figure 16:
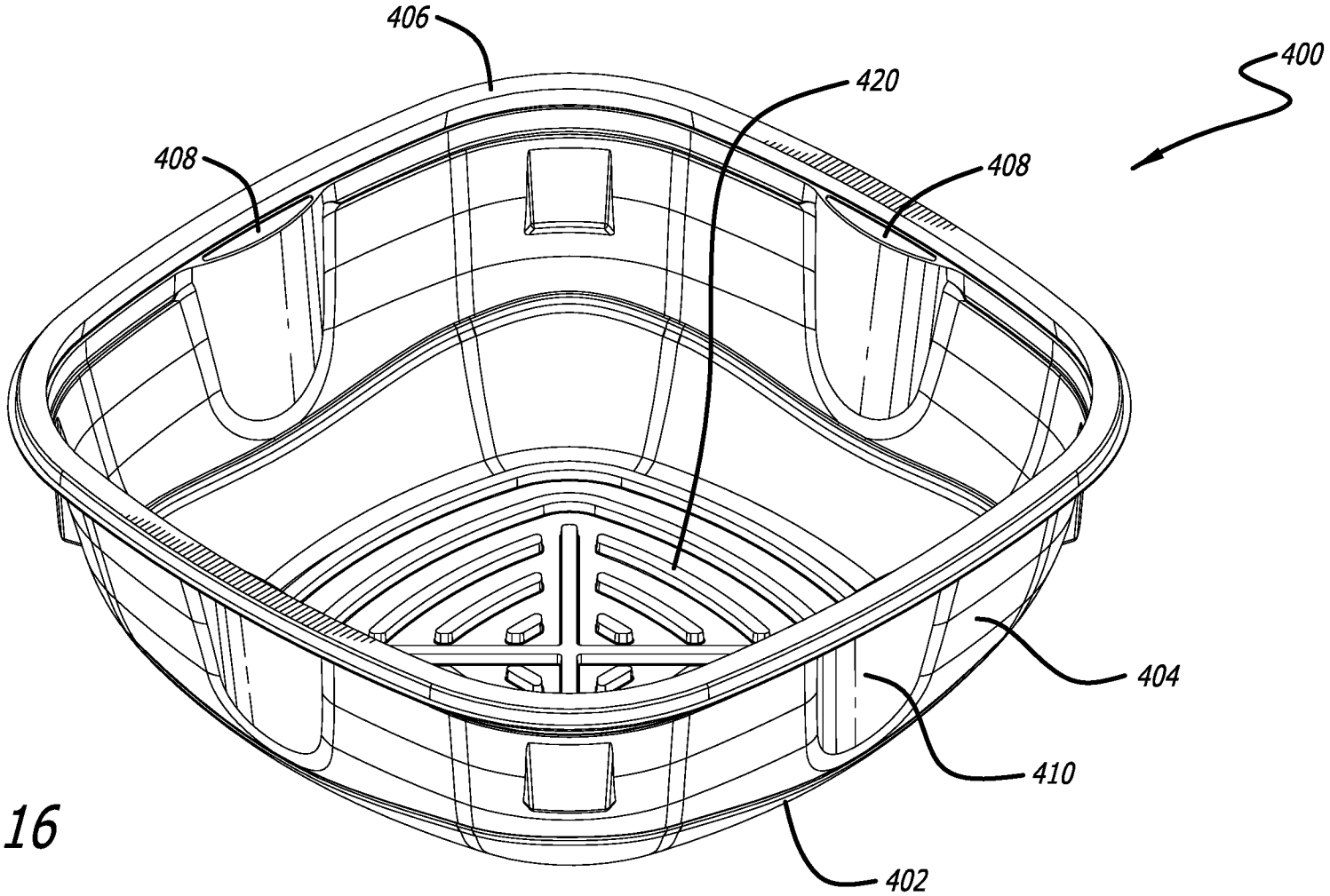
FIG. 16 is a perspective view of the container in accordance with a fourth embodiment of the present invention.
Figure 17:
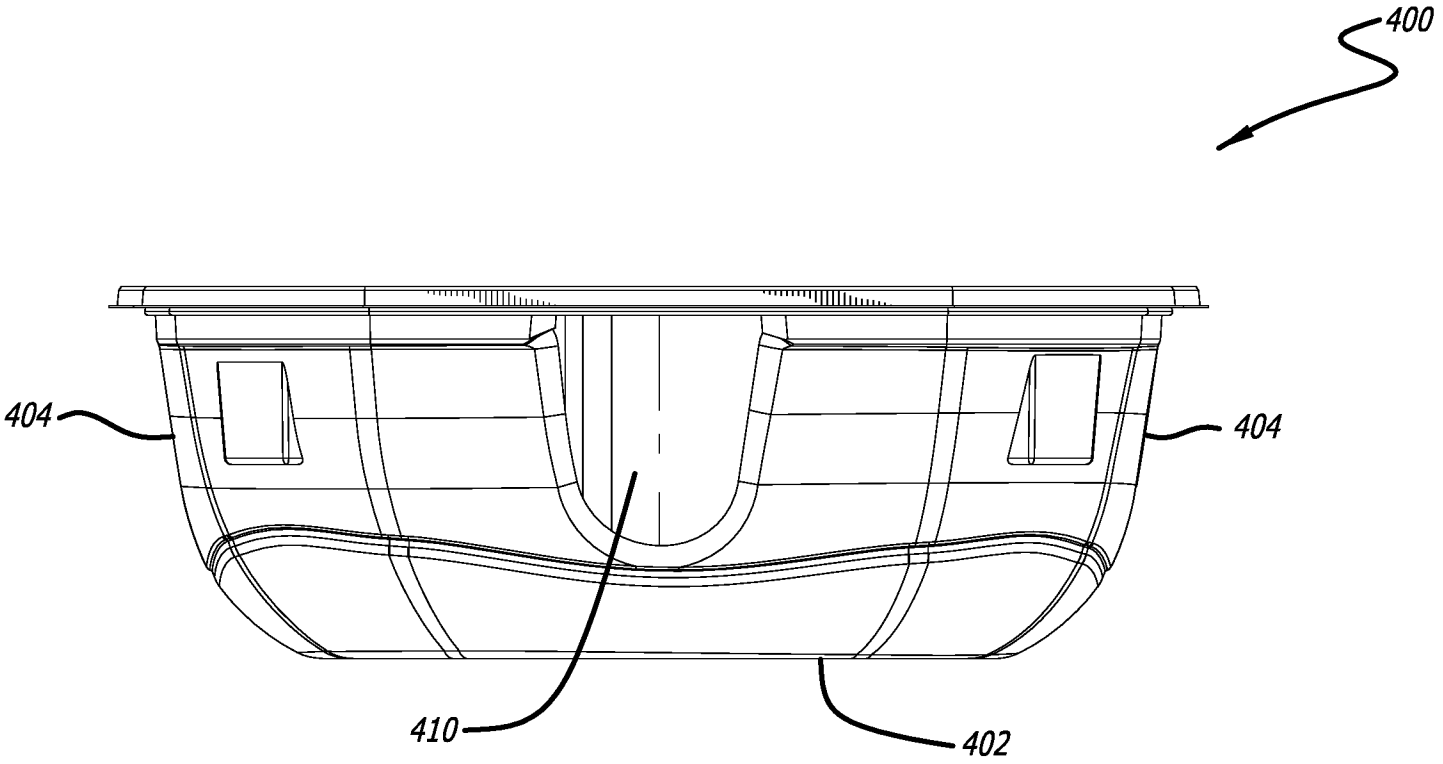
FIG. 17 is a front elevational view of the container in accordance with the fourth embodiment of the present invention.
Figure 18:
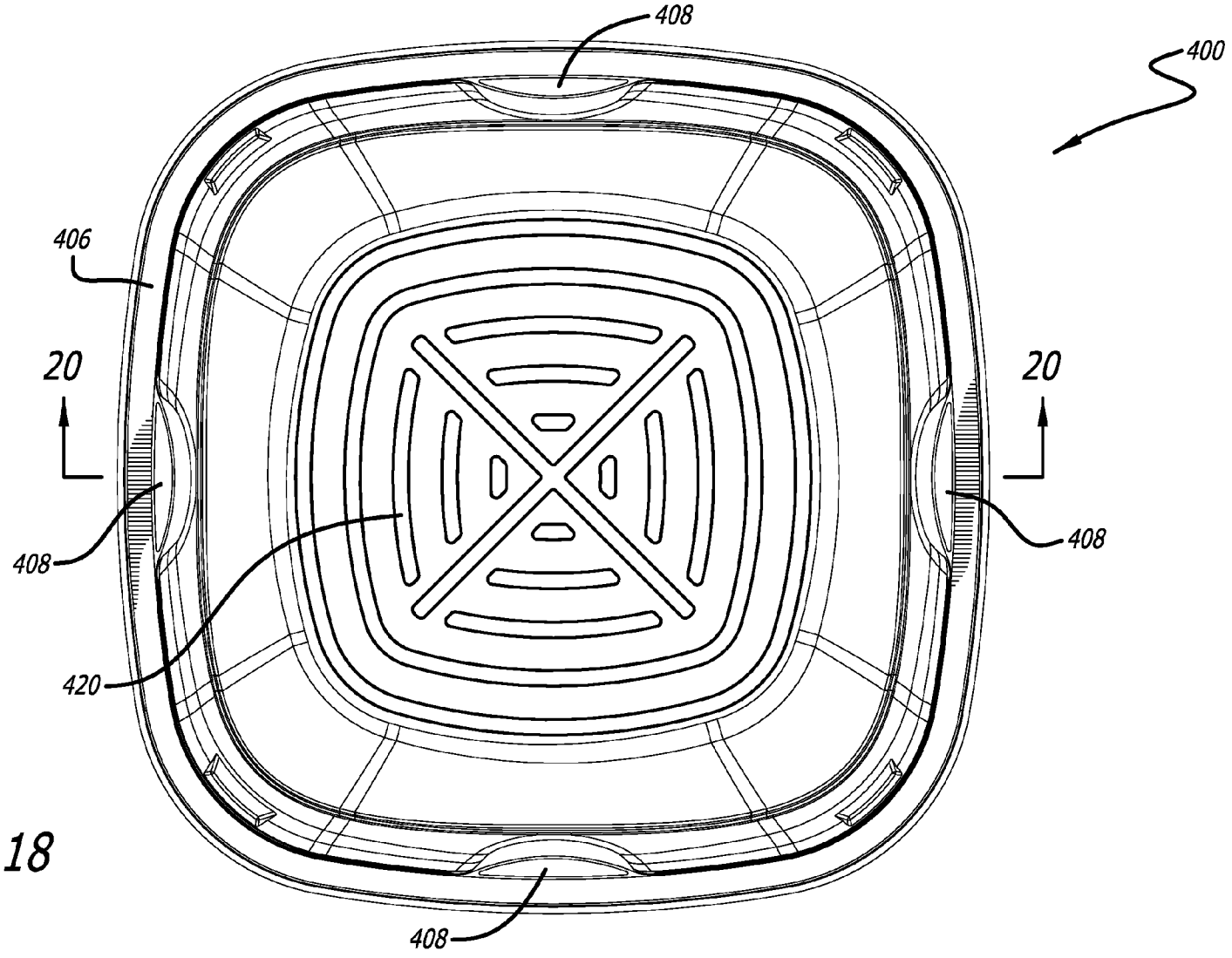
FIG. 18 is a top plan view of the container in accordance with the fourth embodiment of the present invention.
Figure 19:
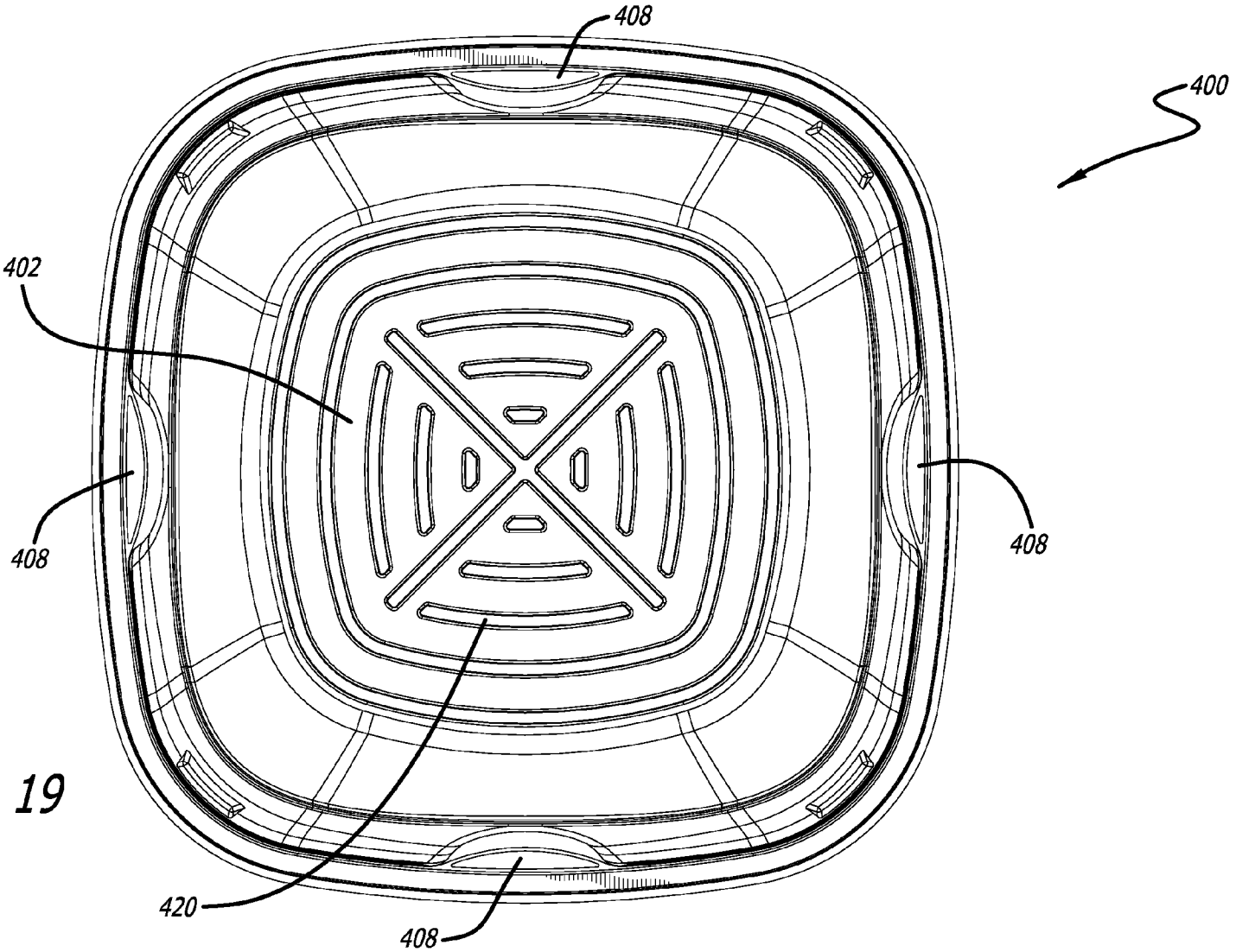
FIG. 19 is a bottom plan view of the container in accordance with the fourth embodiment of the present invention.
Figure 20:
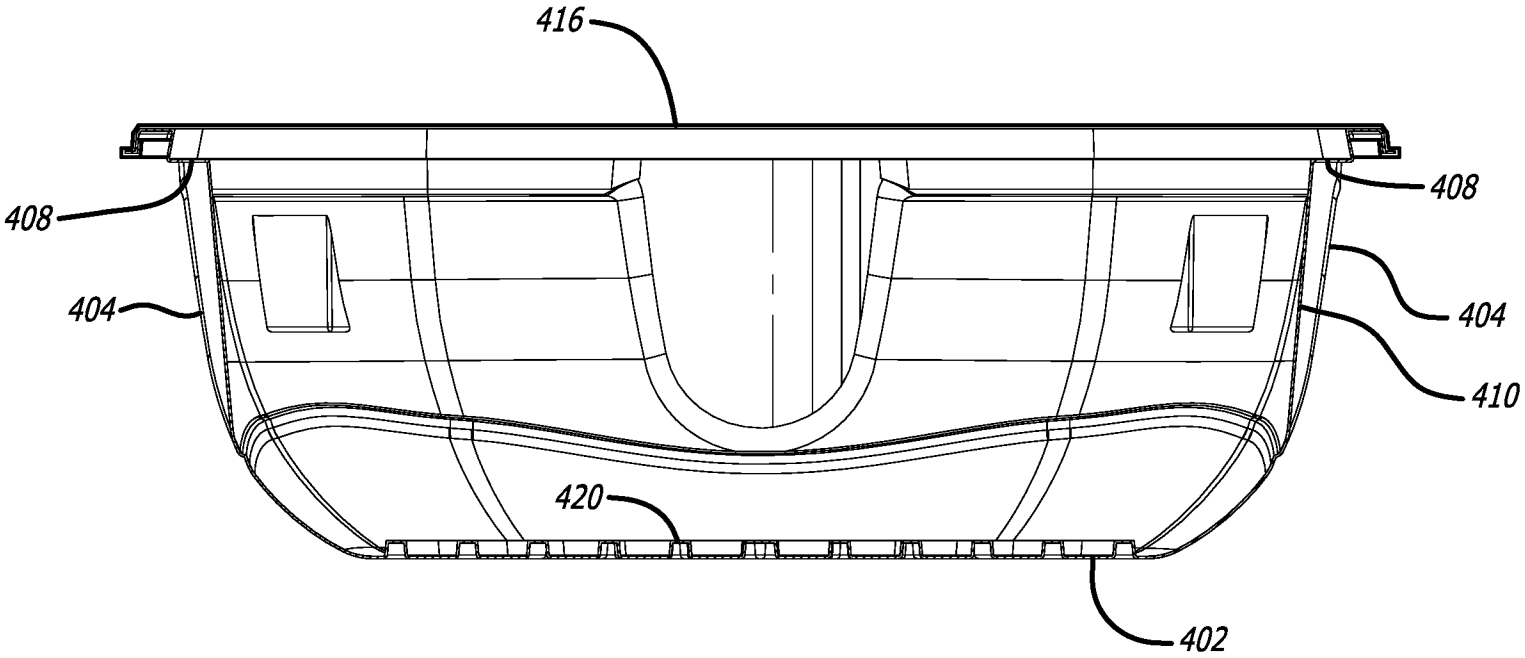
FIG. 20 is a cross-sectional view of the enclosed container sealed with a film taken along line 20-20 of the fourth embodiment of the present invention of FIG. 18.
Figure 21:
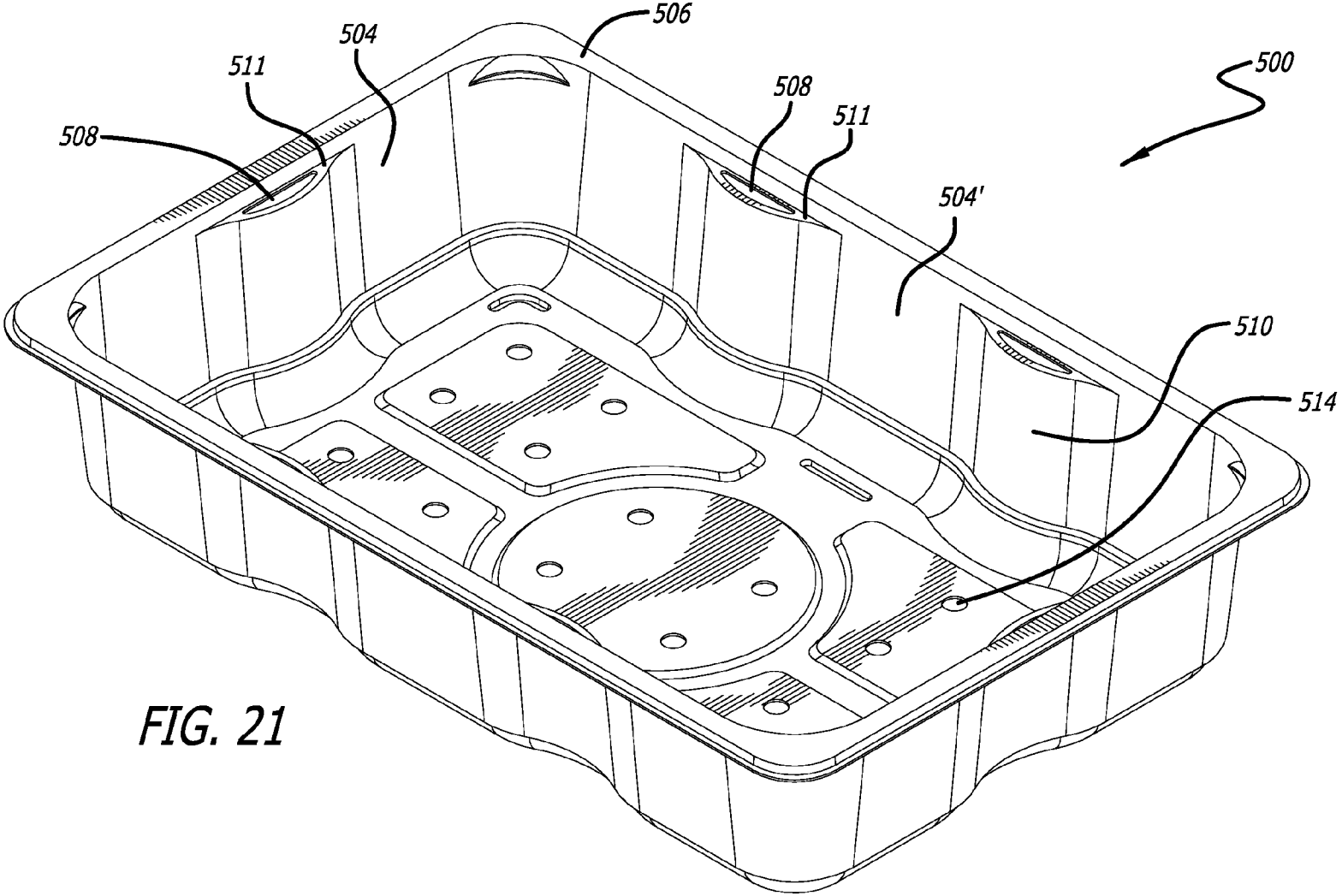
FIG. 21 is a perspective view of the container in accordance with a fifth embodiment of the present invention.
Figure 22:
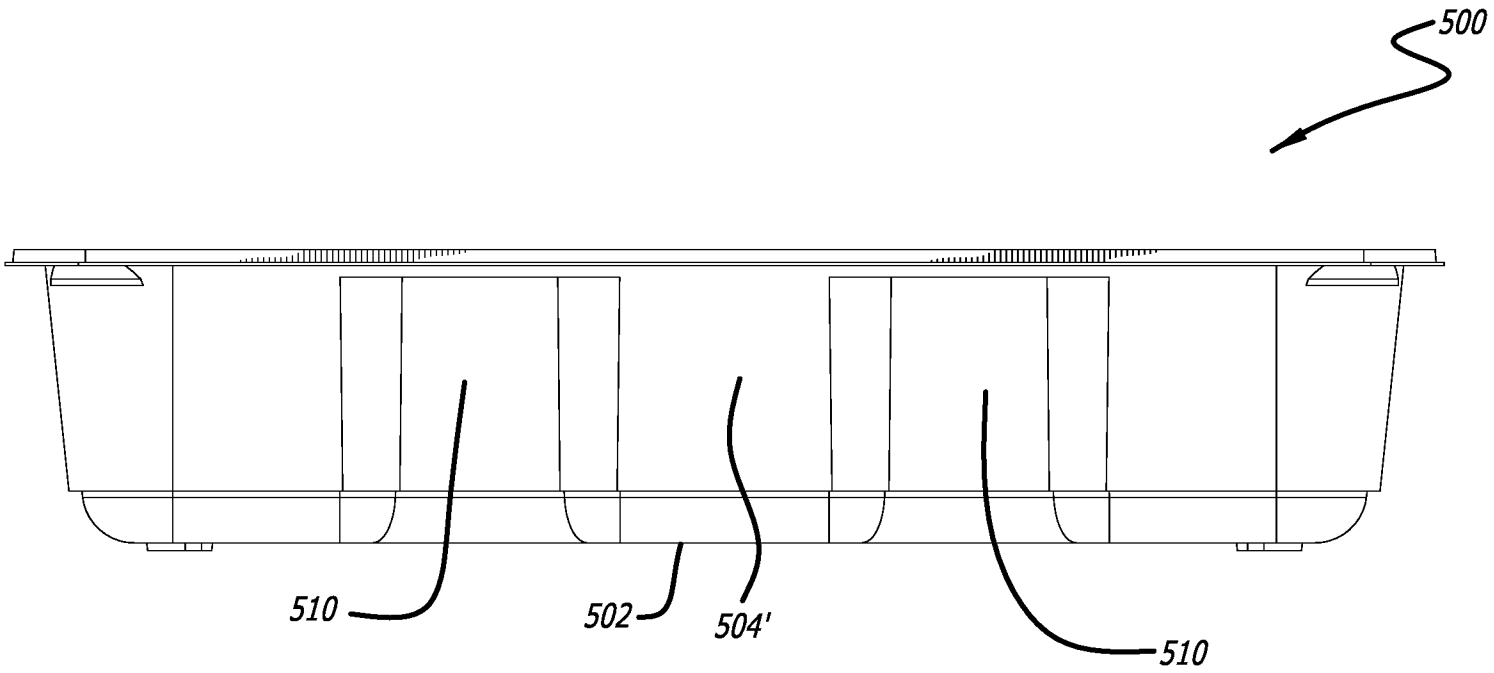
FIG. 22 is a front elevational view of the container in accordance with the fifth embodiment of the present invention.
Figure 23:
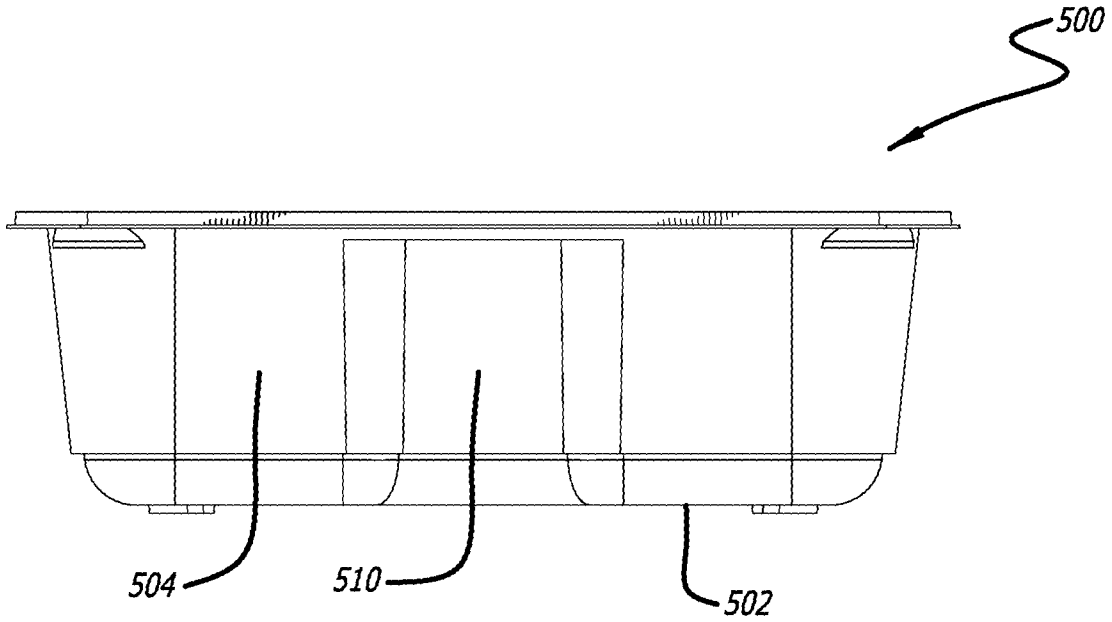
FIG. 23 is a side elevational view of the container in accordance with the fifth embodiment of the present invention.
Figure 24:
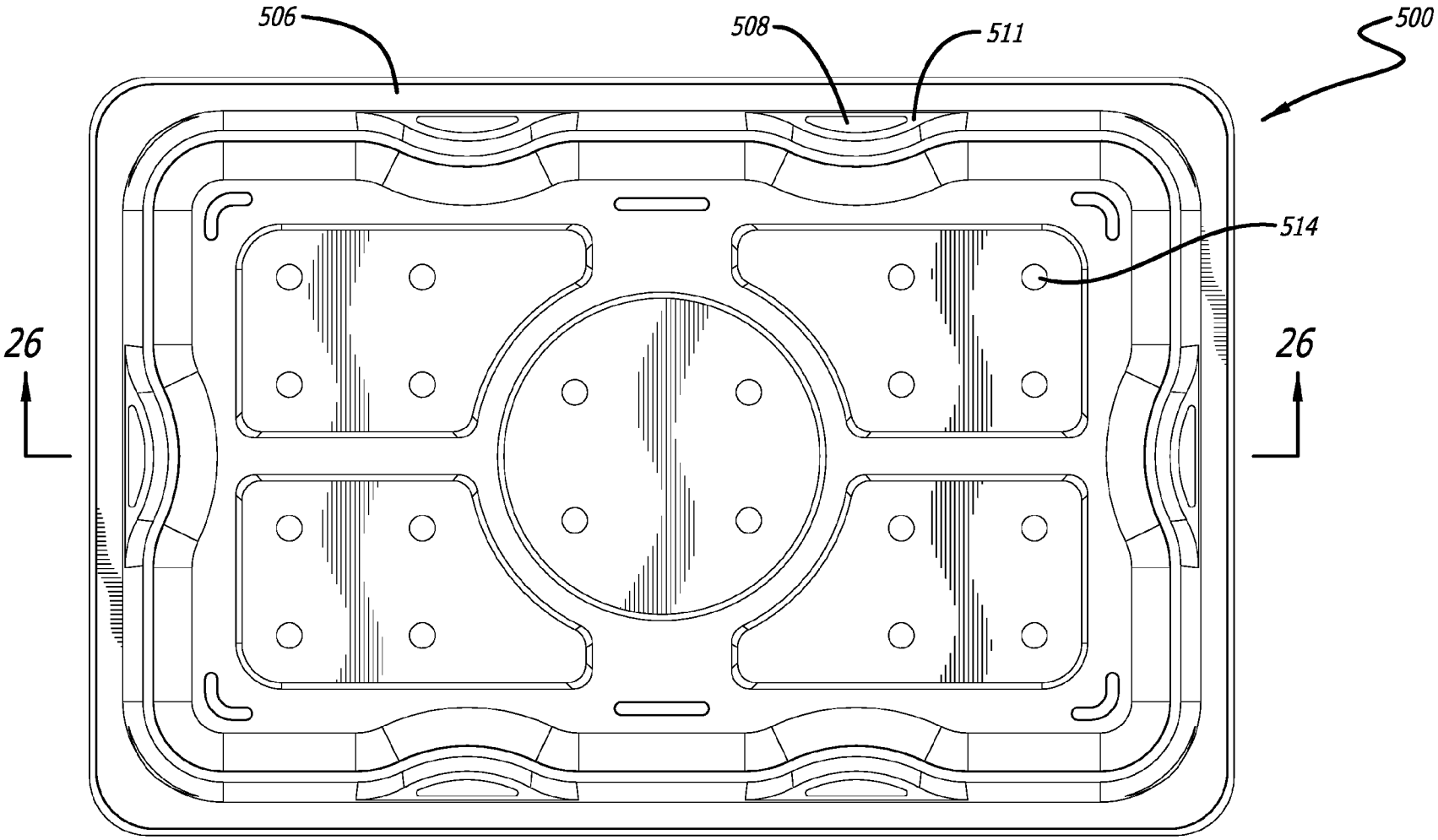
FIG. 24 is a top plan view of the container in accordance with the fifth embodiment of the present invention.
Figure 25:
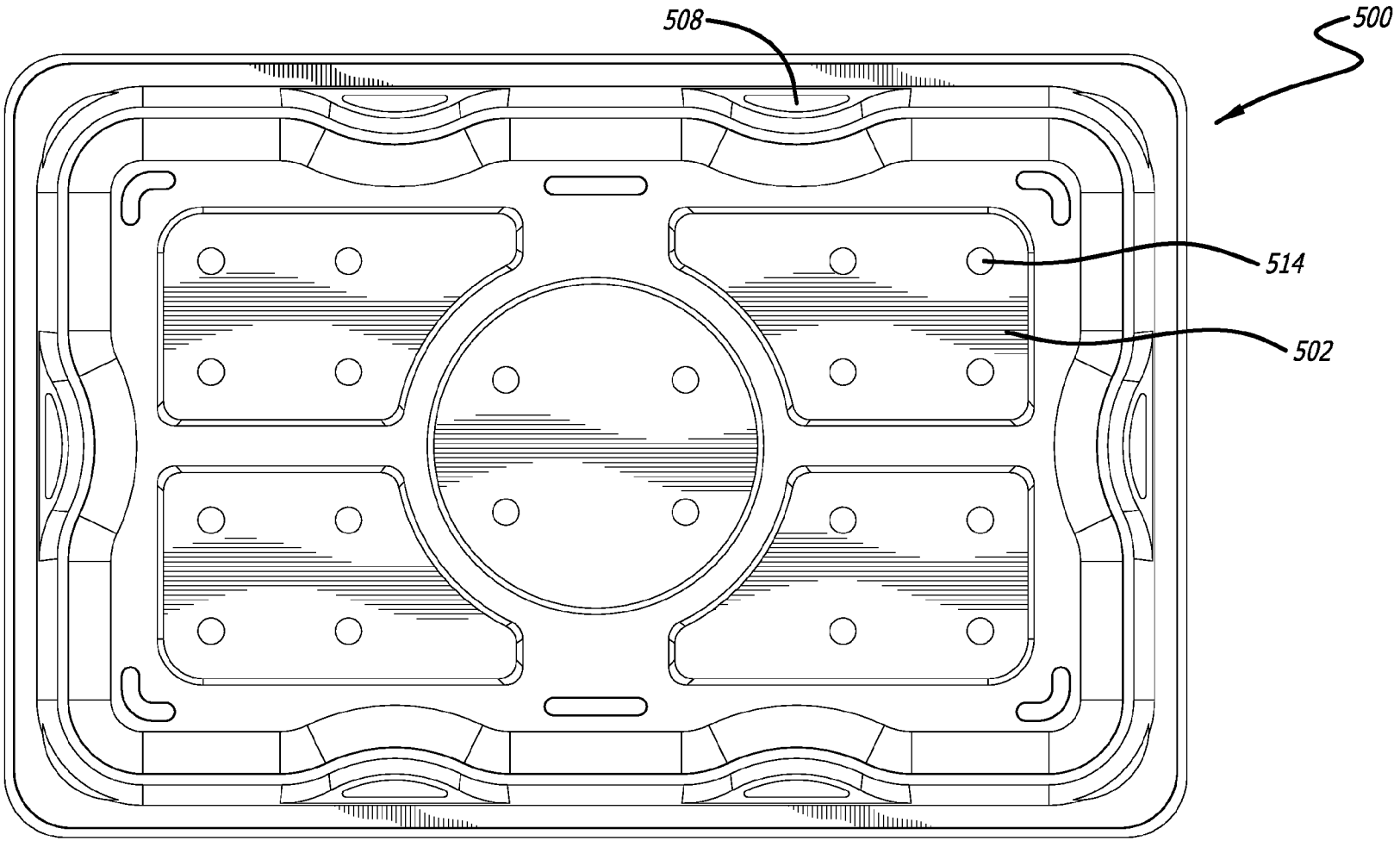
FIG. 25 is a bottom plan view of the container in accordance with the fifth embodiment of the present invention.
Figure 26:
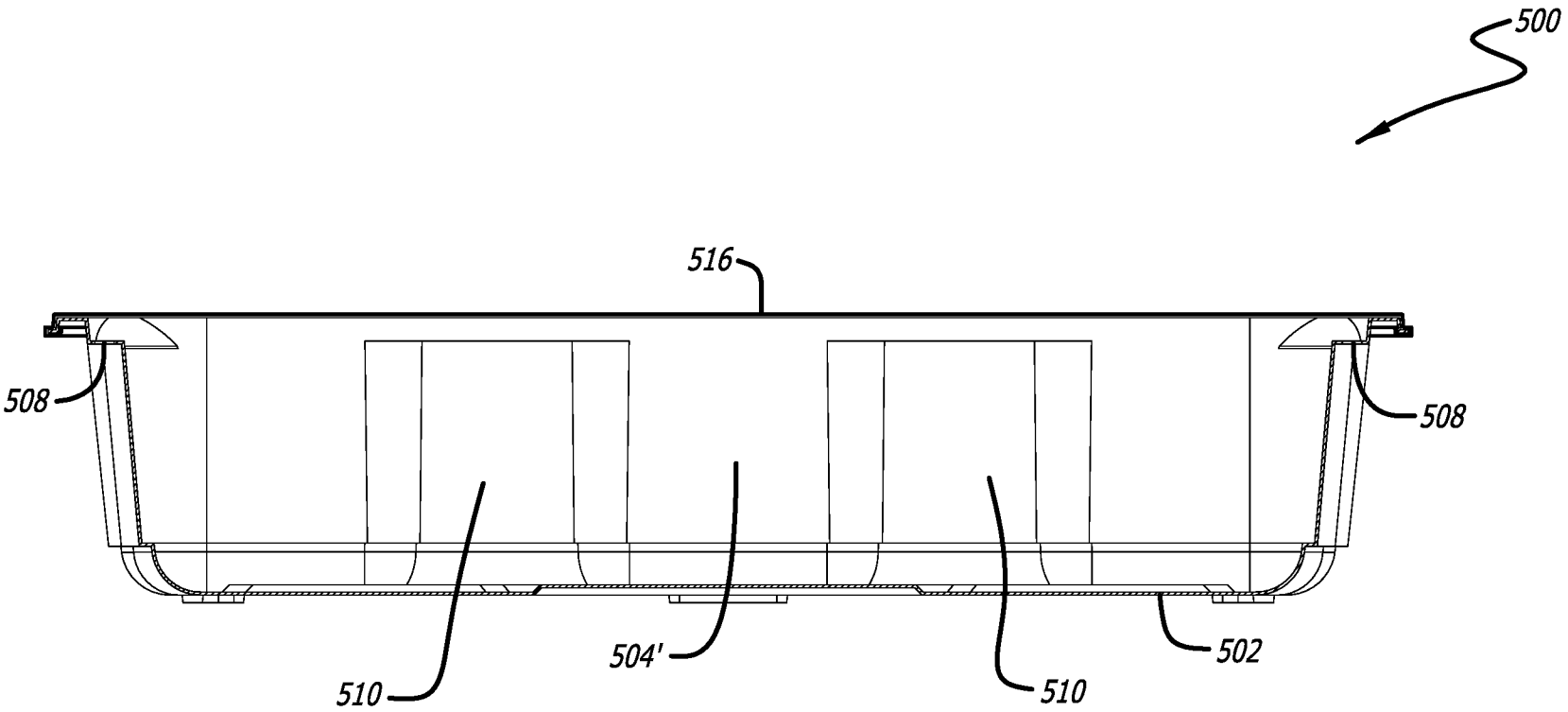
FIG. 26 is a cross-sectional view of the enclosed container sealed with a film taken along line 26-26 of the fifth embodiment of the present invention of FIG. 24.
Figure 27:
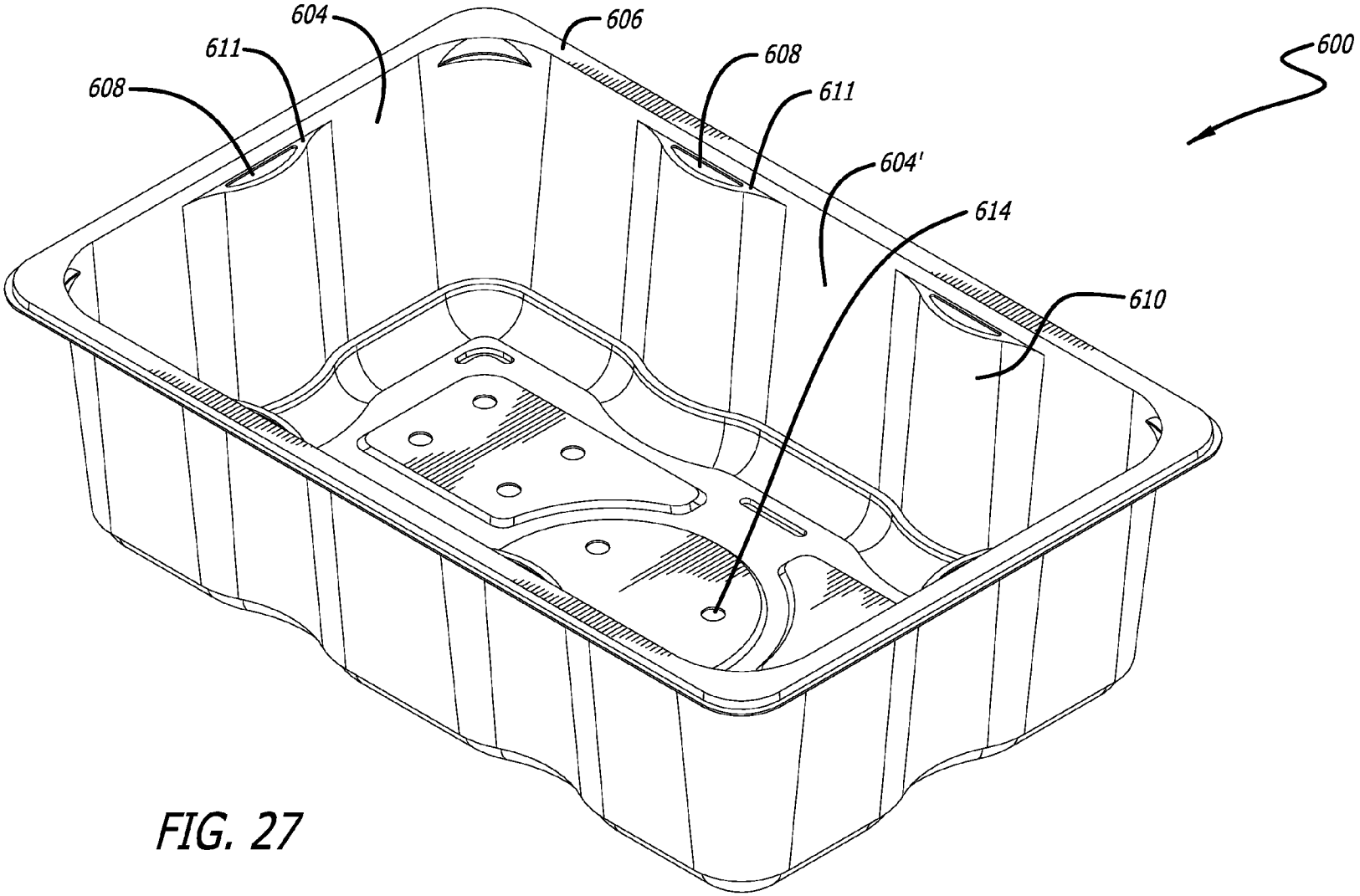
FIG. 27 is a perspective view of the container in accordance with a sixth embodiment of the present invention.
Figure 28:
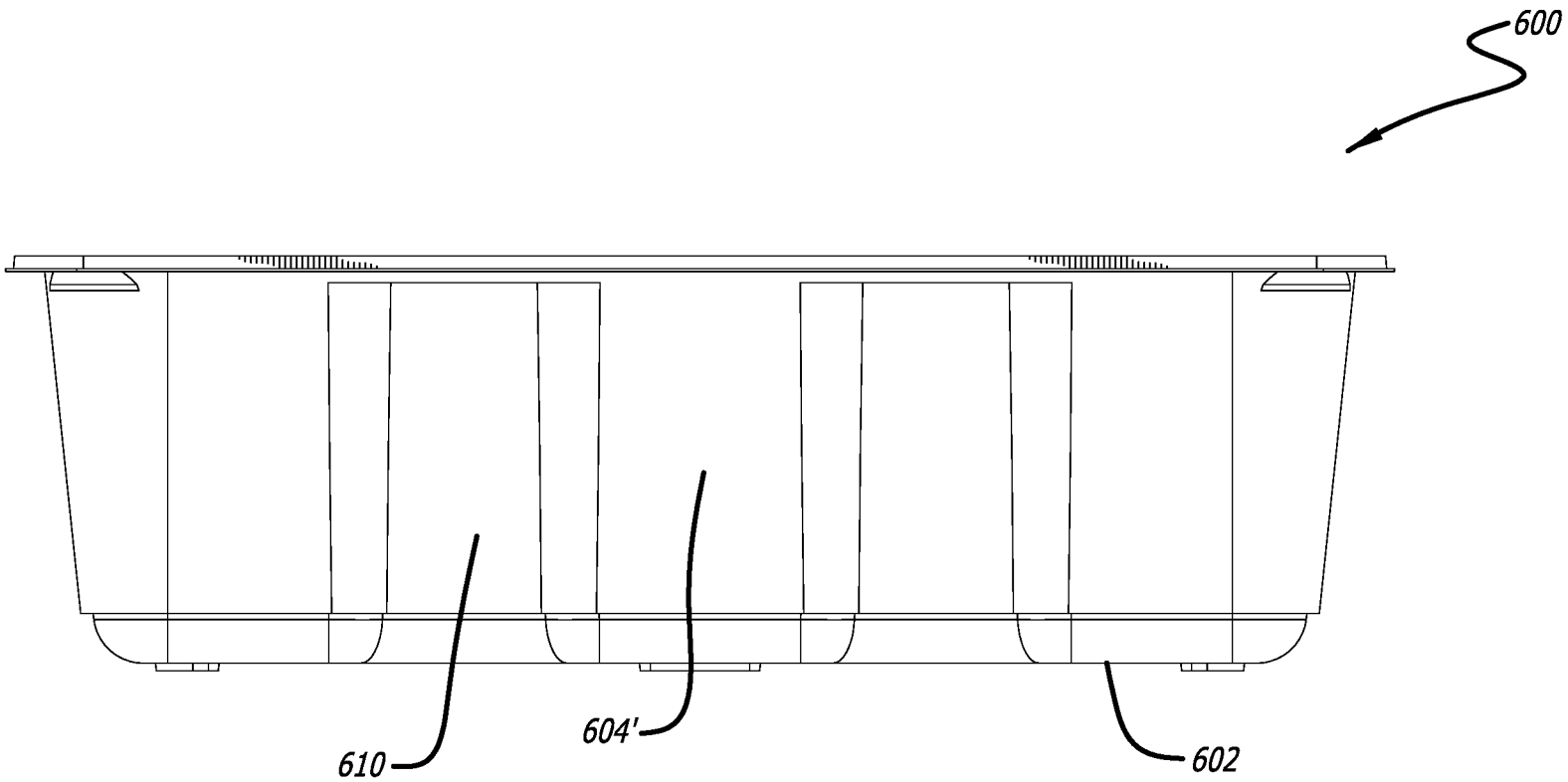
FIG. 28 is a front elevational view of the container in accordance with the sixth embodiment of the present invention.
Figure 29:
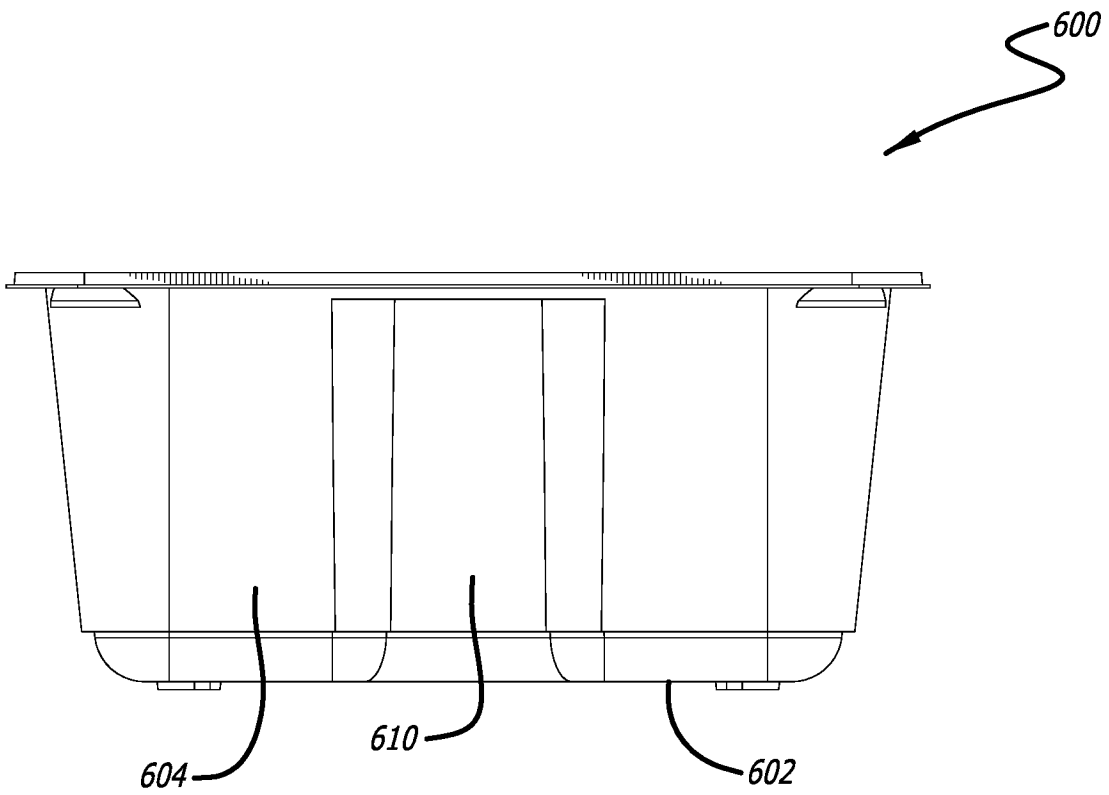
FIG. 29 is a side elevational view of the container in accordance with the sixth embodiment of the present invention.
Figure 30A:
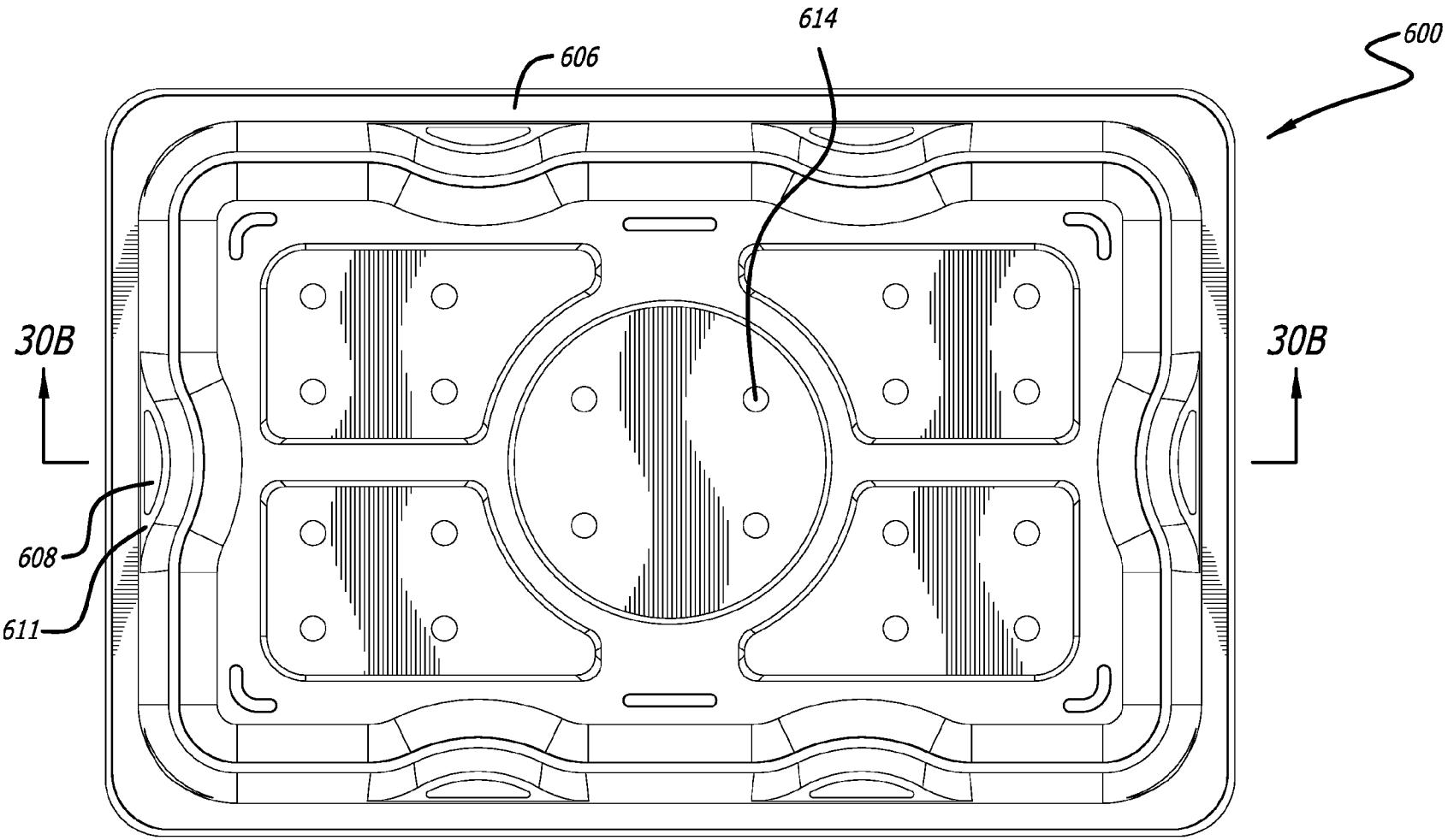
FIG. 30A is a top plan view of the container in accordance with the sixth embodiment of the present invention.
Figure 30B:
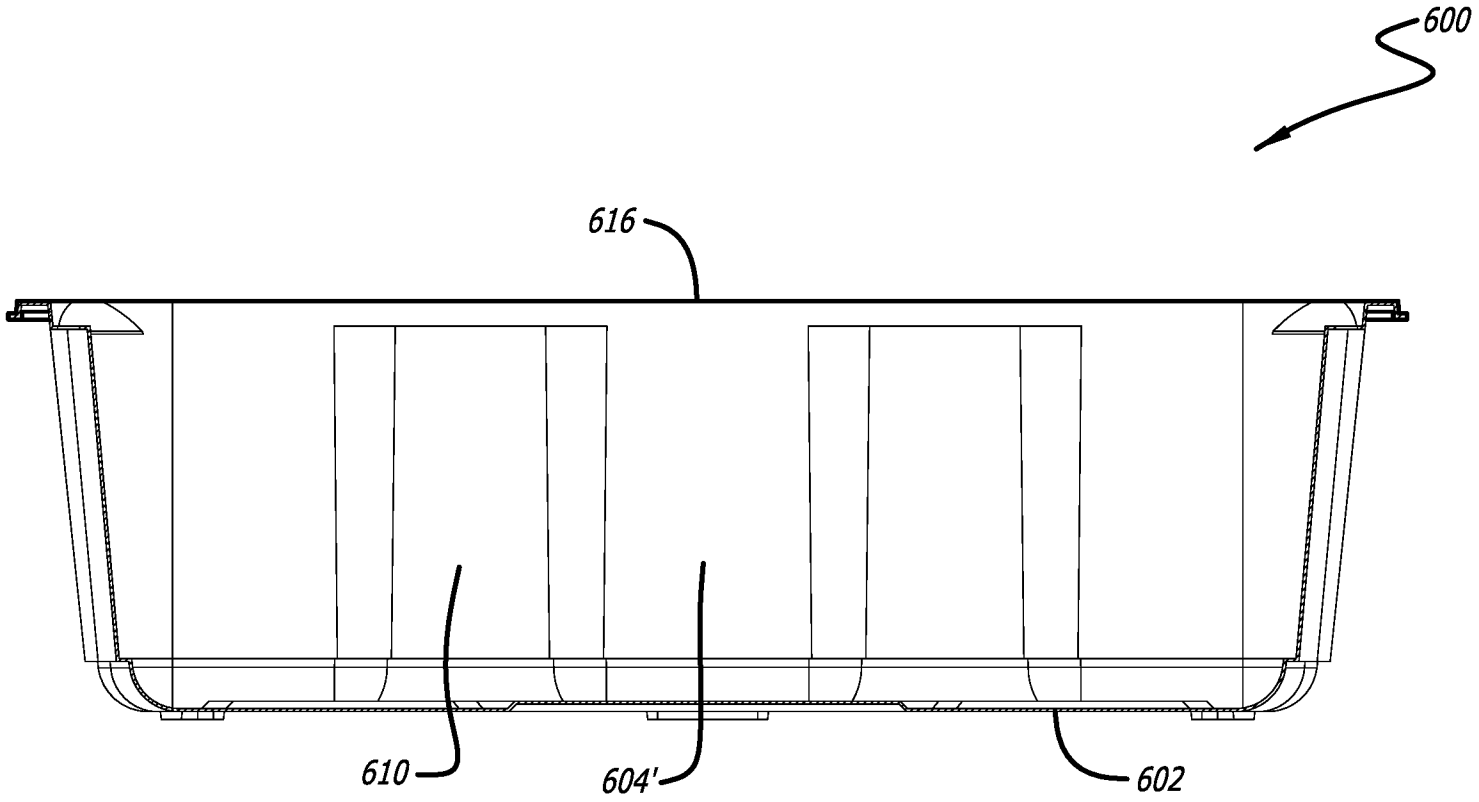
FIG. 30B is a cross-sectional view of the enclosed container sealed with a film taken along line 30-30 of the sixth embodiment of the present invention of FIG. 30A.
Figure 31:
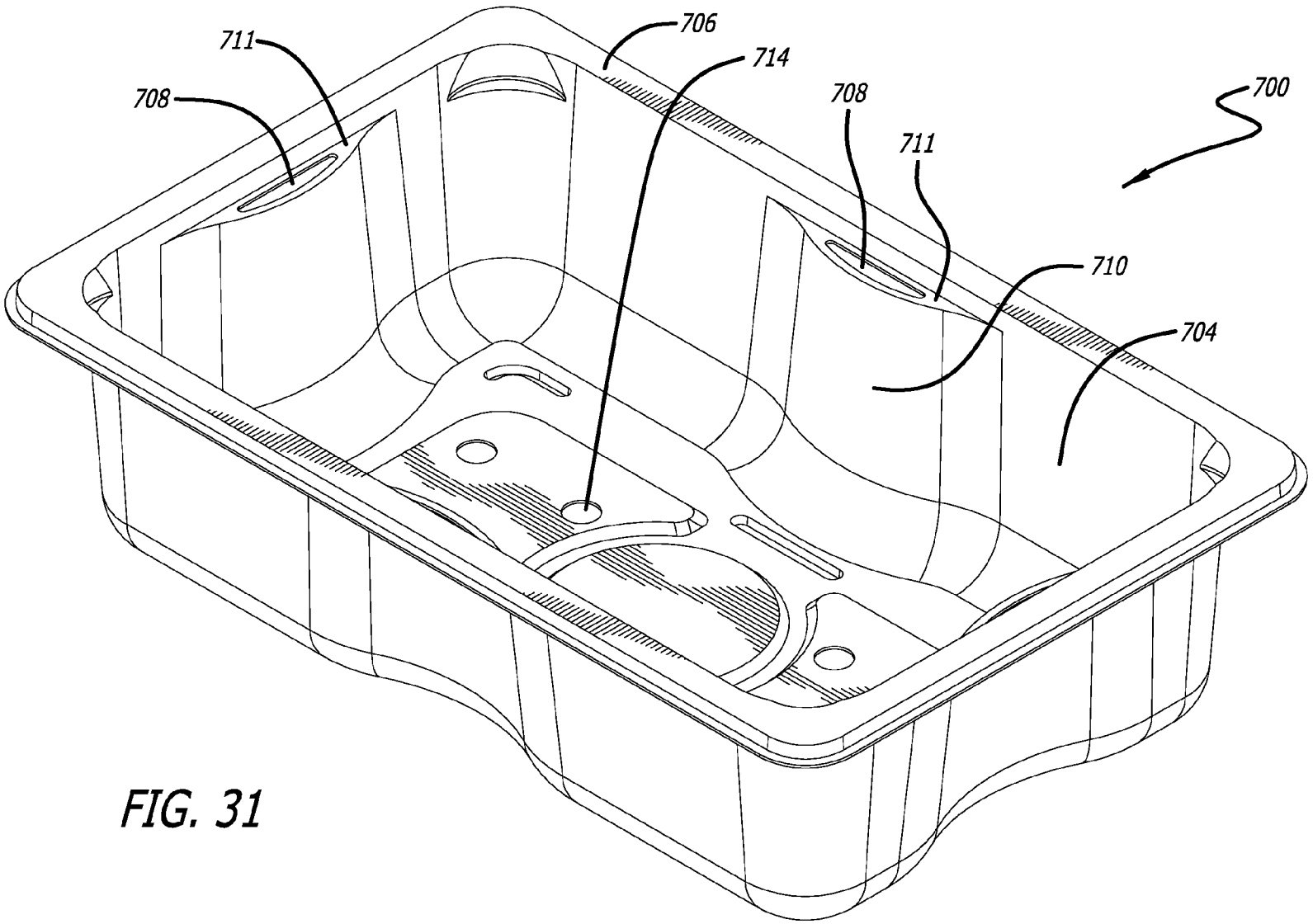
FIG. 31 is a perspective view of the container in accordance with a seventh embodiment of the present invention.
Figure 32:
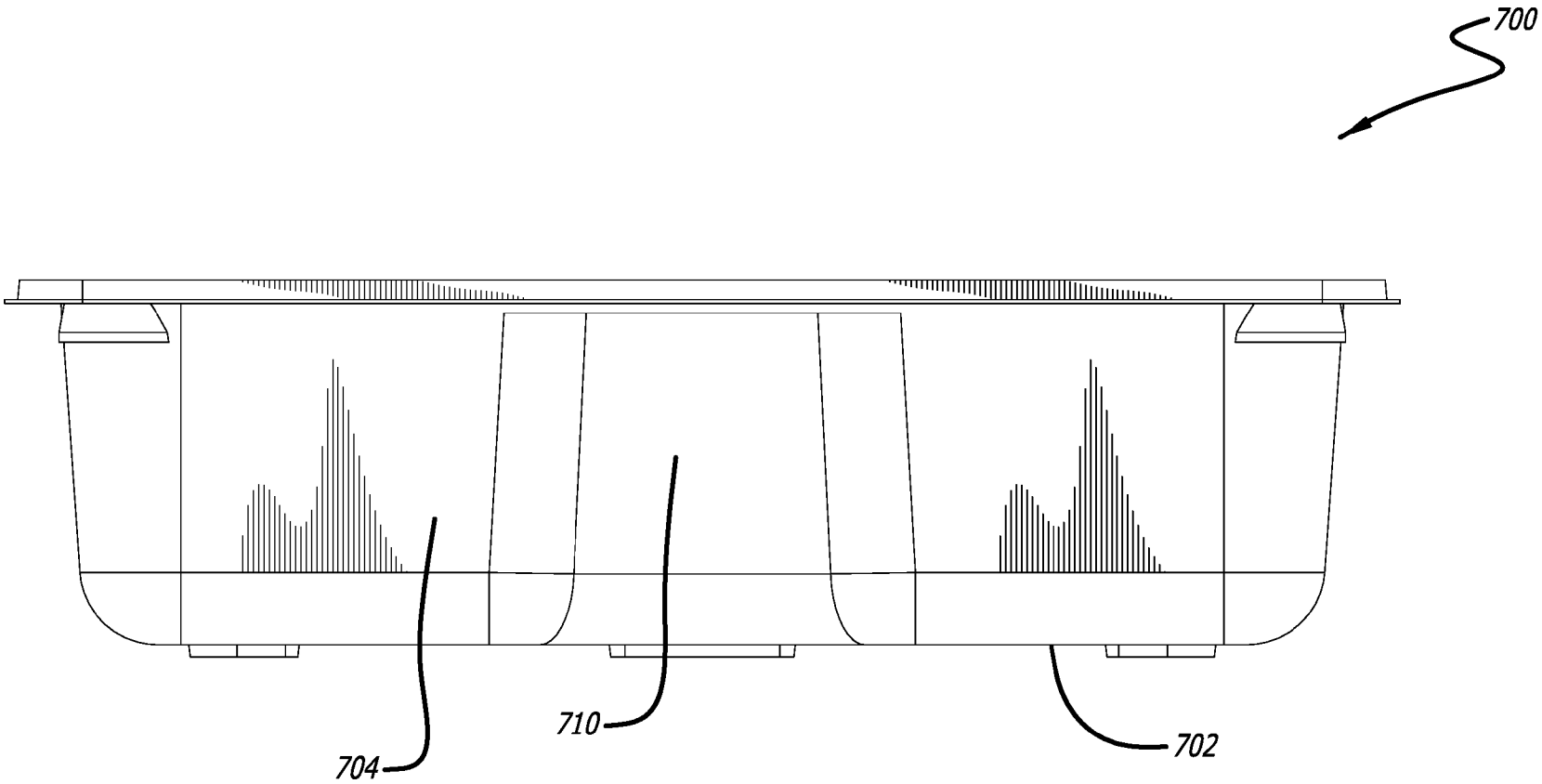
FIG. 32 is a front elevational view of the container in accordance with the seventh embodiment of the present invention.
Figure 33:
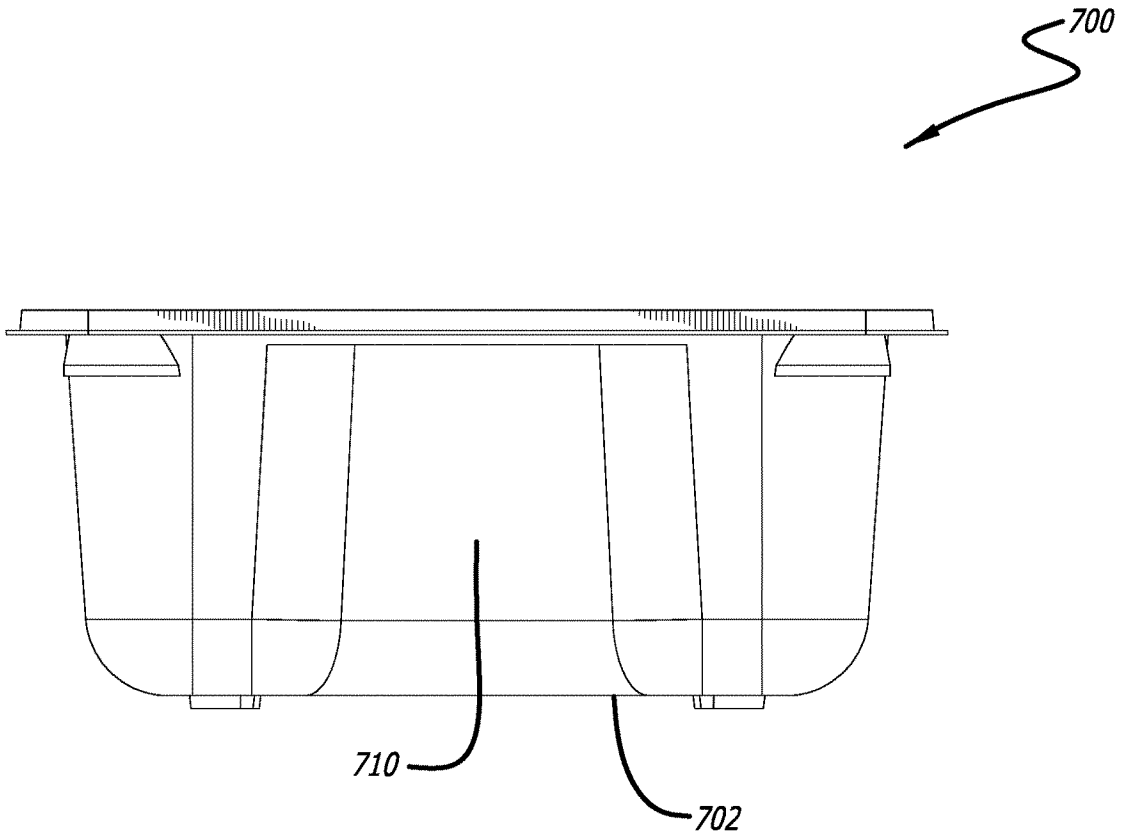
FIG. 33 is a side elevational view of the container in accordance with the seventh embodiment of the present invention.
Figure 34:
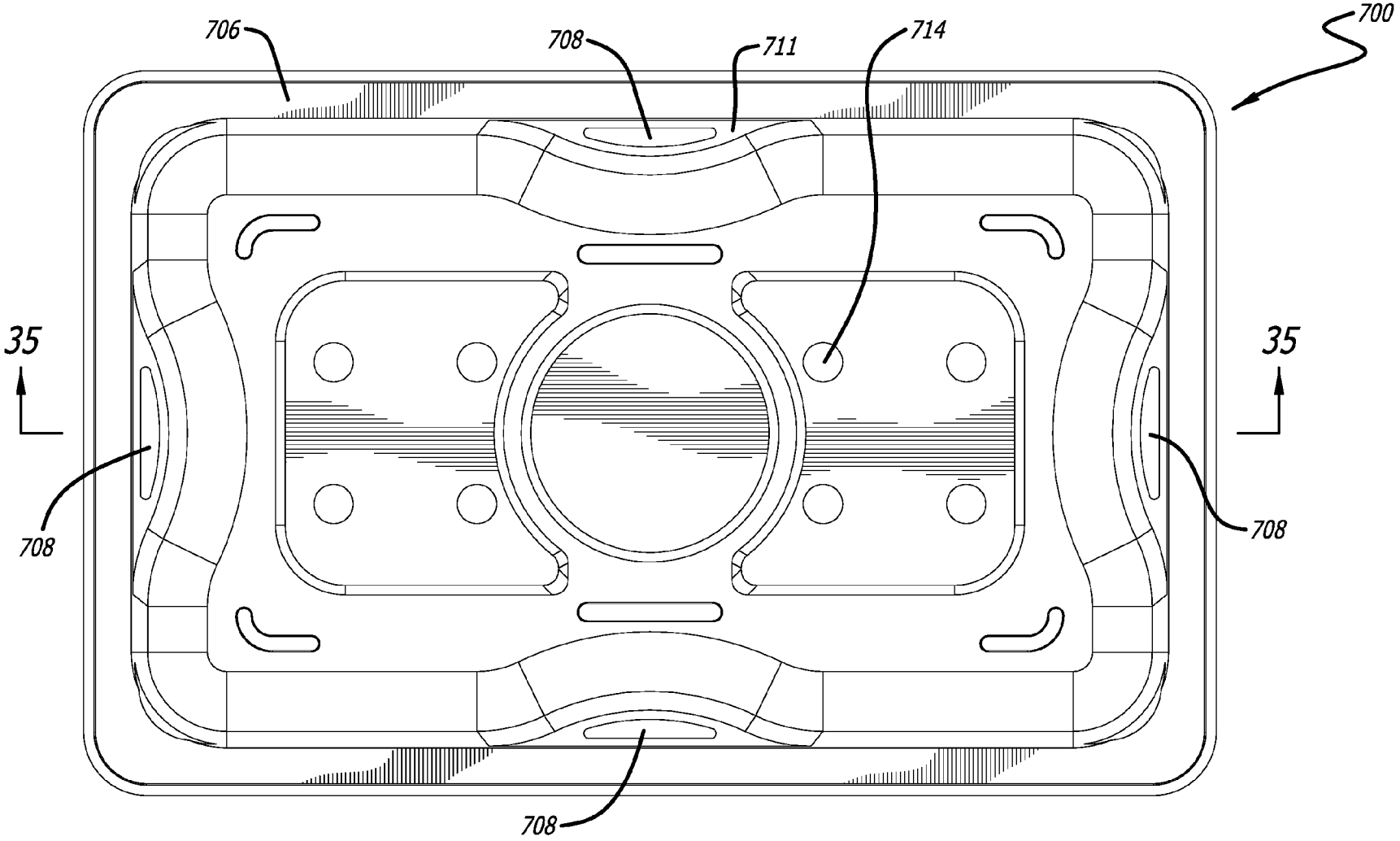
FIG. 34 is a top plan view of the container in accordance with the seventh embodiment of the present invention.
Figure 35:
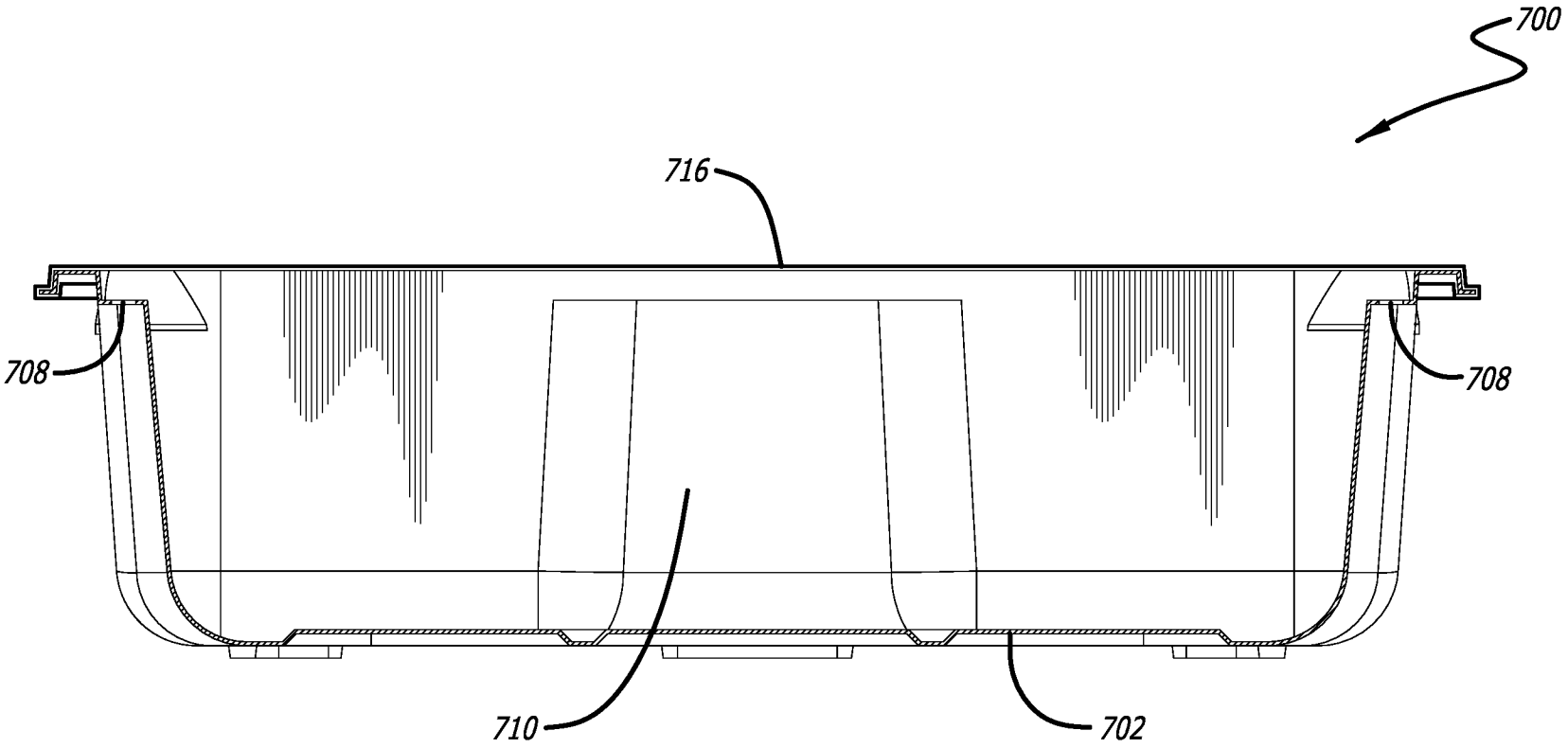
FIG. 35 is a cross-sectional view of the enclosed container sealed with a film taken along line 35-35 of the seventh embodiment of the present invention of FIG. 34.
Figure 36:
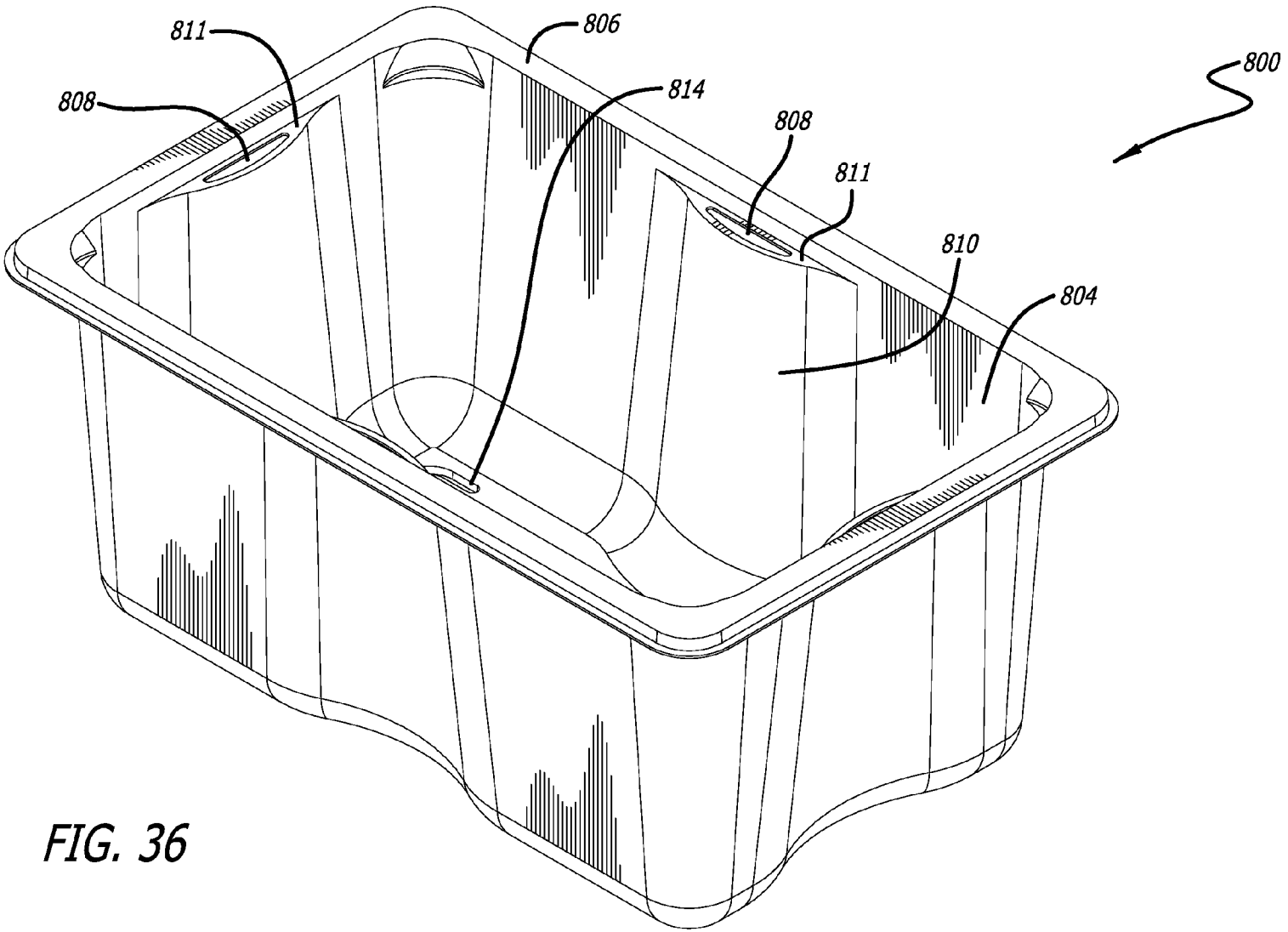
FIG. 36 is a perspective view of the container in accordance with an eighth embodiment of the present invention.
Figure 37:
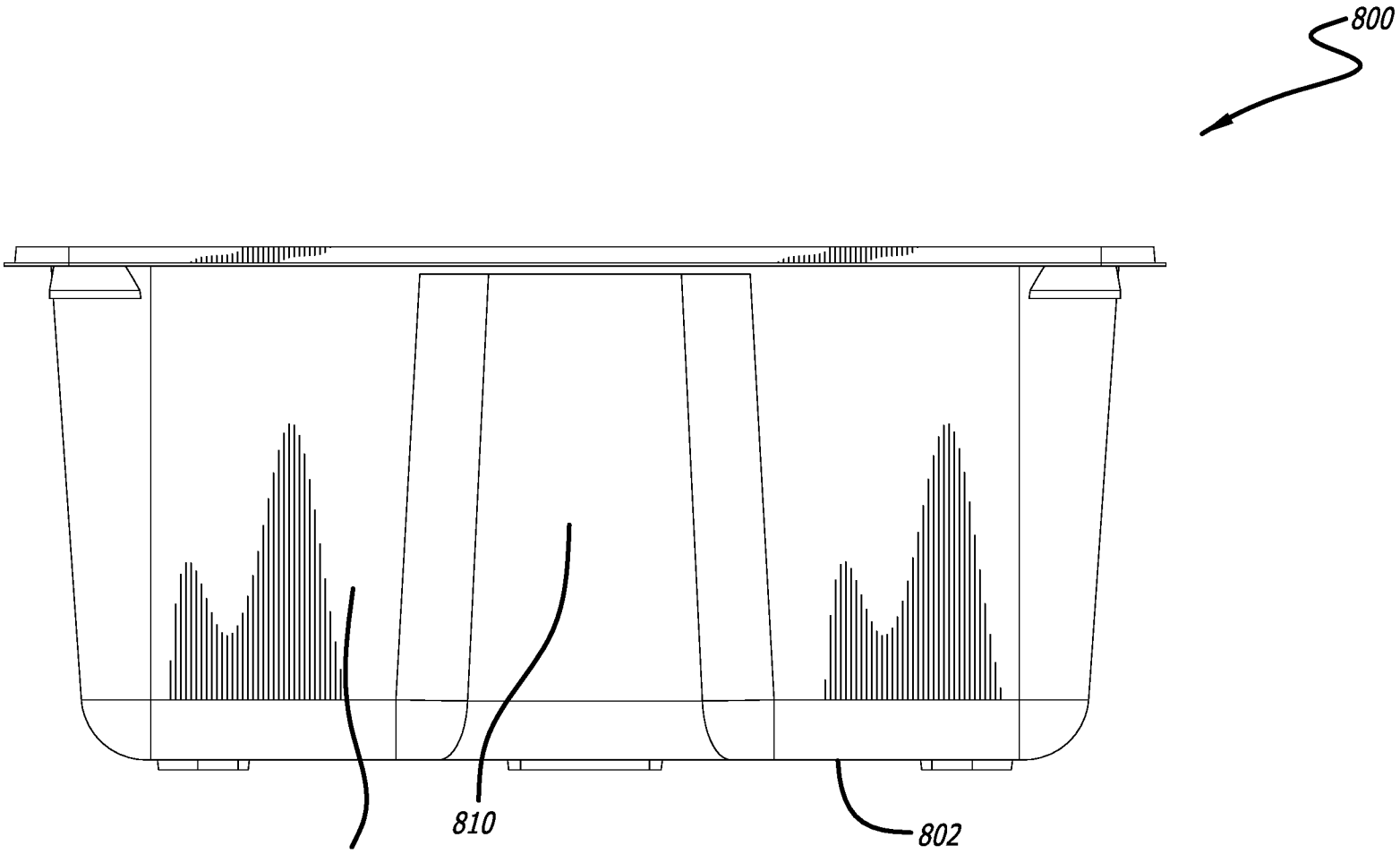
FIG. 37 is a front elevational view of the container in accordance with the eighth embodiment of the present invention.
Figure 38:
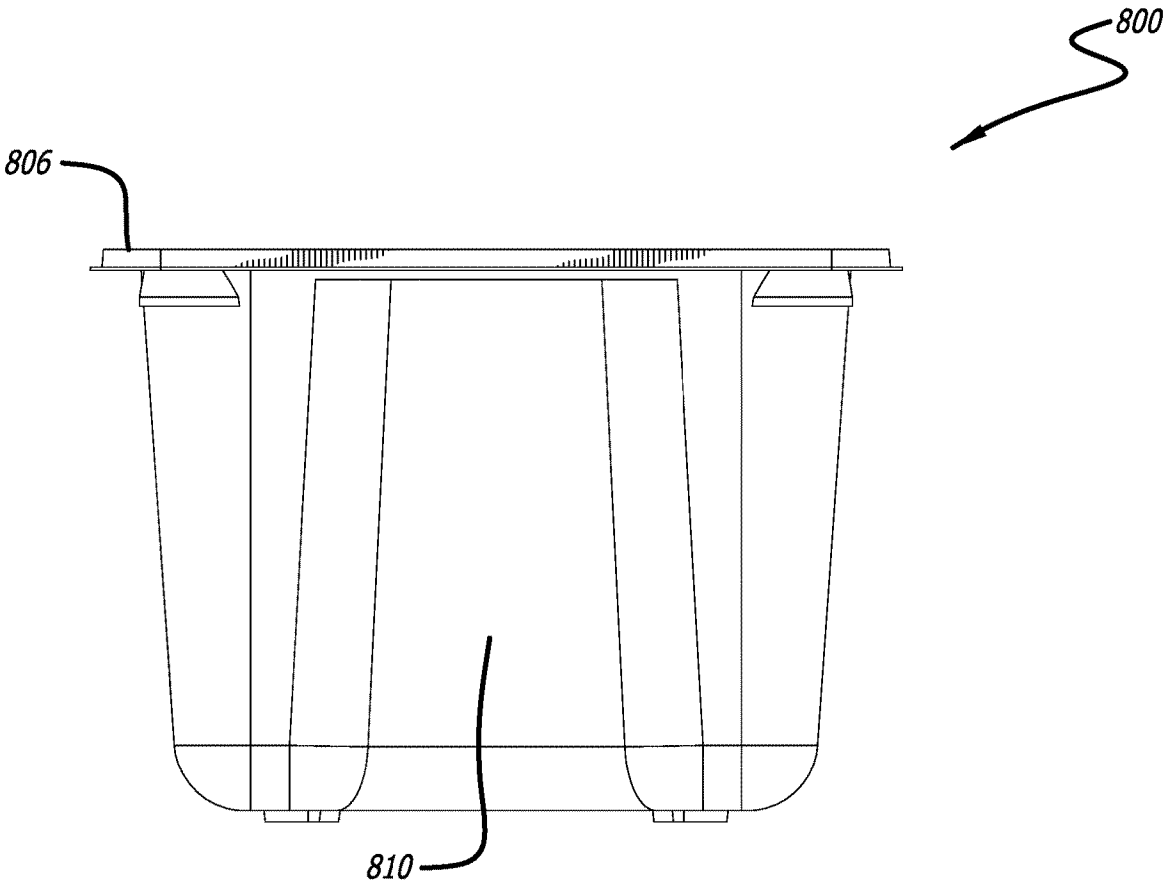
FIG. 38 is a side elevational view of the container in accordance with the eighth embodiment of the present invention.
Figure 39A:
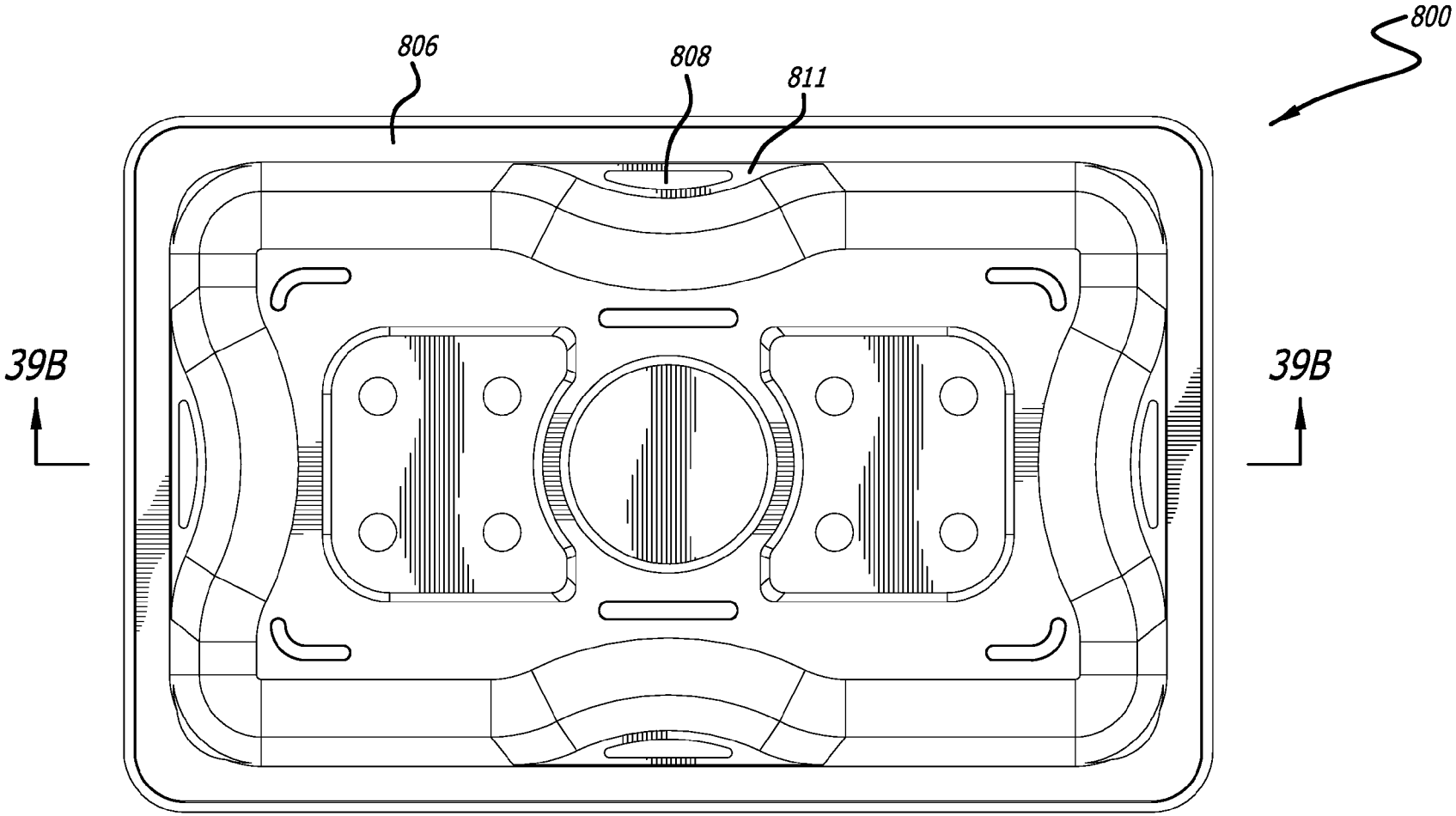
FIG. 39A is a top plan view of the container in accordance with the eighth embodiment of the present invention.
Figure 39B:
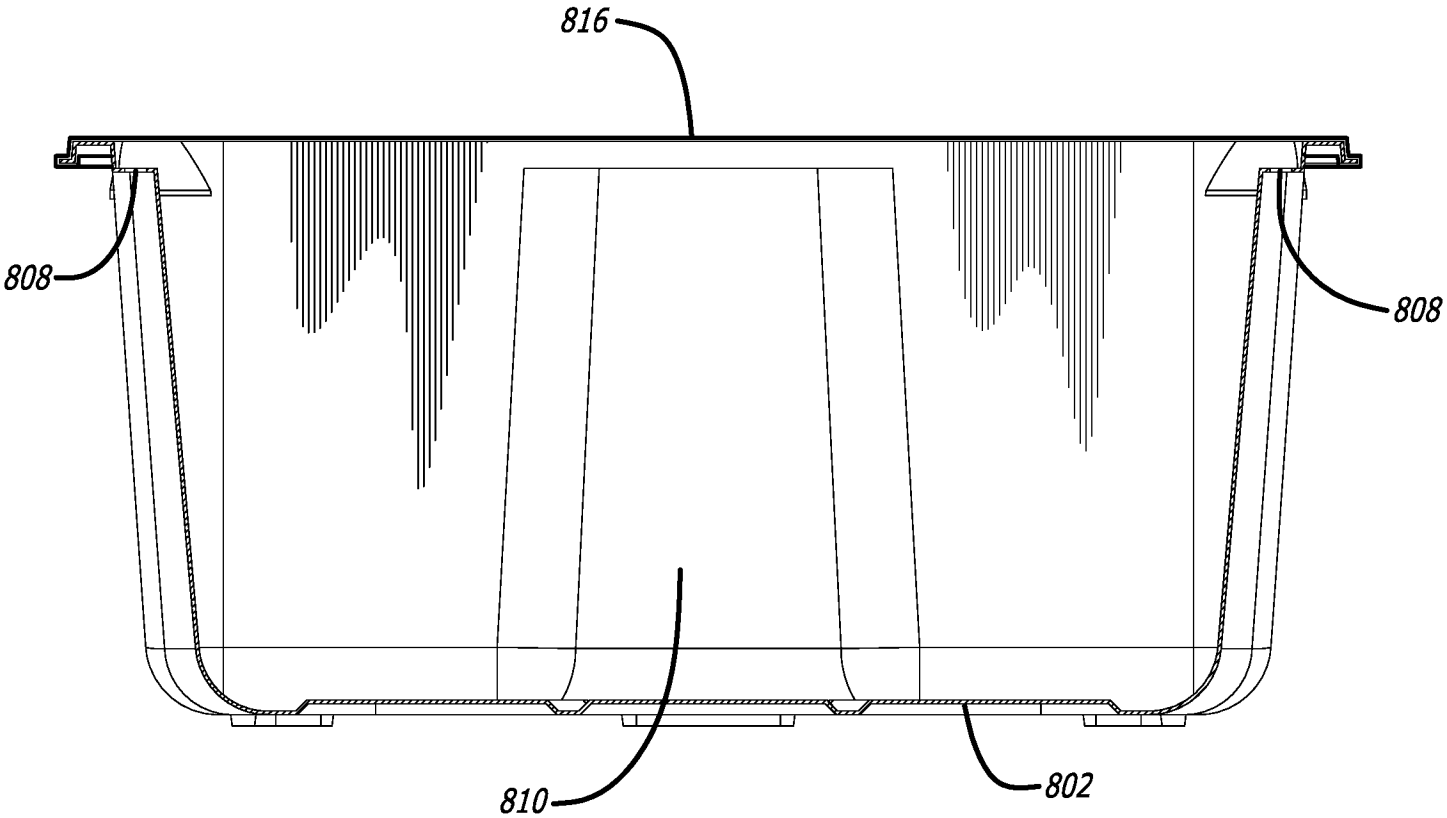
FIG. 39B is a cross-sectional view of the enclosed container sealed with a film taken along line 39-39 of the eighth embodiment of the present invention of FIG. 39A.
Figure 40:
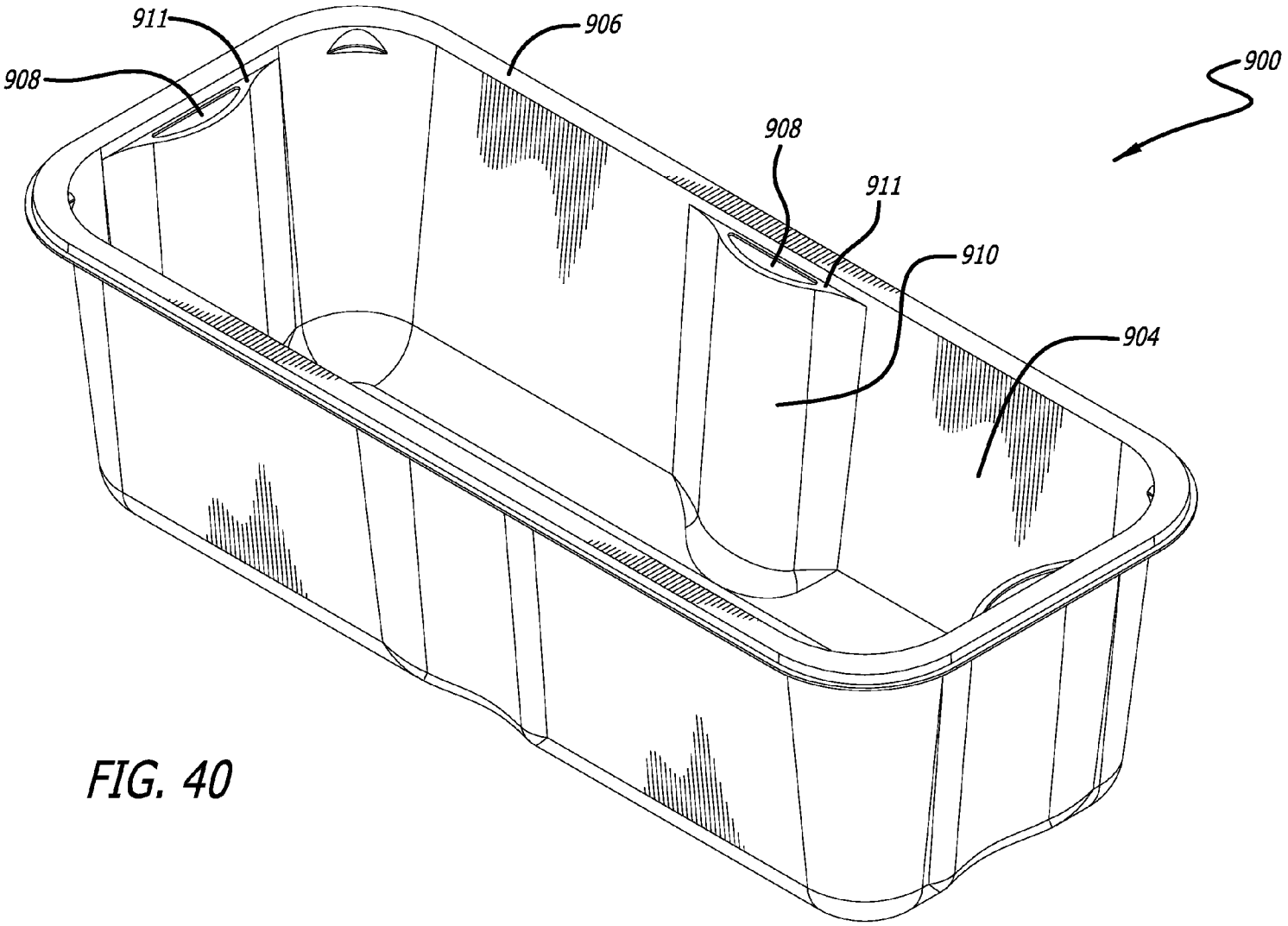
FIG. 40 is a perspective view of the container in accordance with a ninth embodiment of the present invention.
Figure 41:
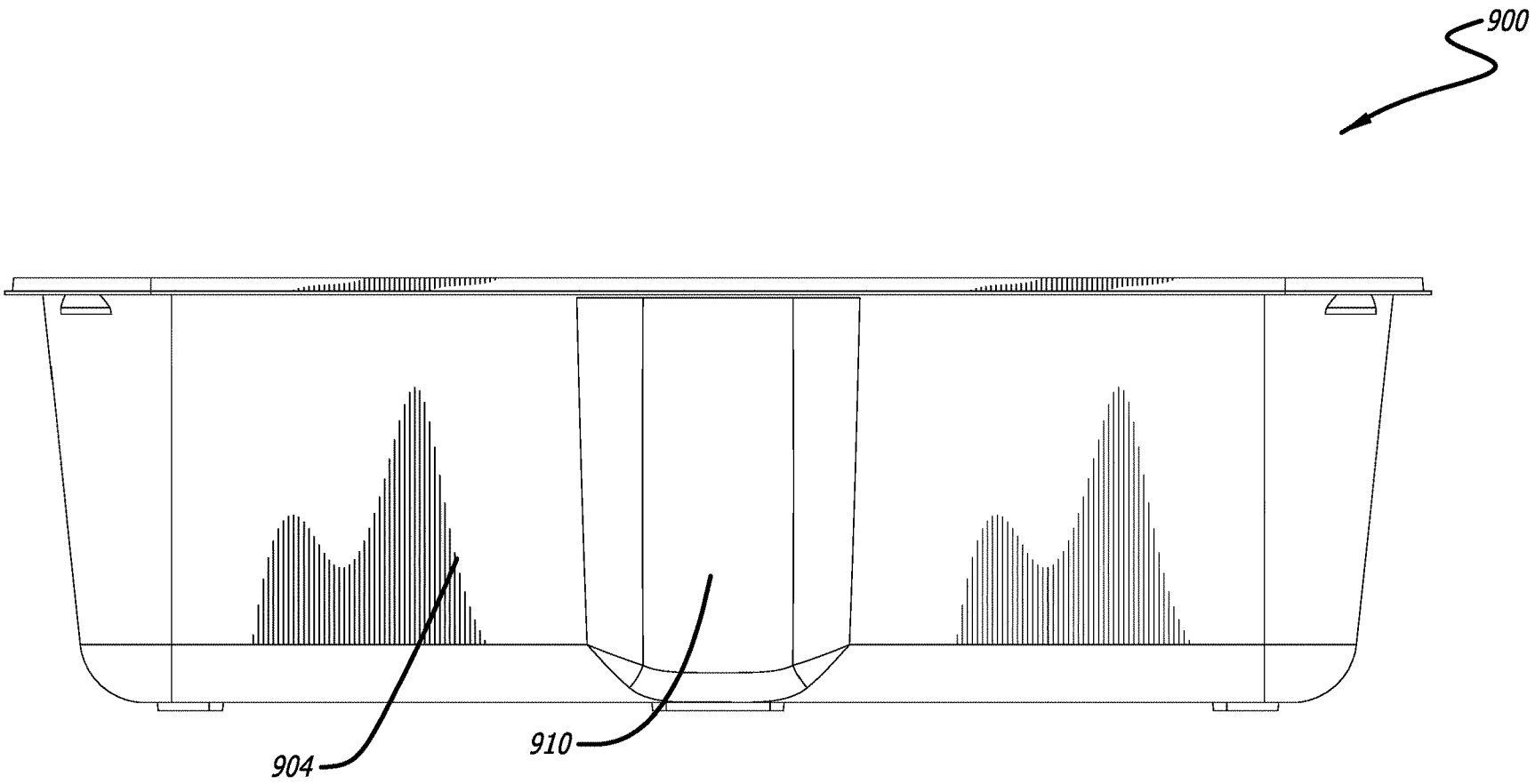
FIG. 41 is a front elevational view of the container in accordance with the ninth embodiment of the present invention.
Figure 42:
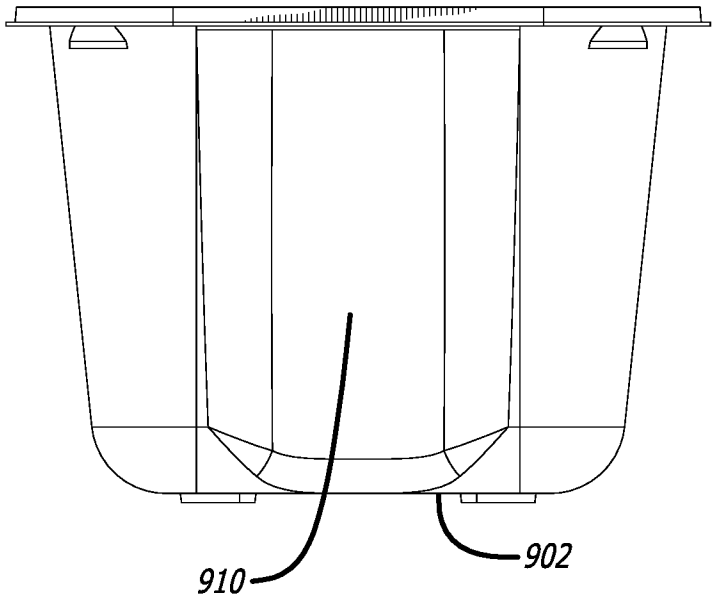
FIG. 42 is a side elevational view of the container in accordance with the ninth embodiment of the present invention.
Figure 43:
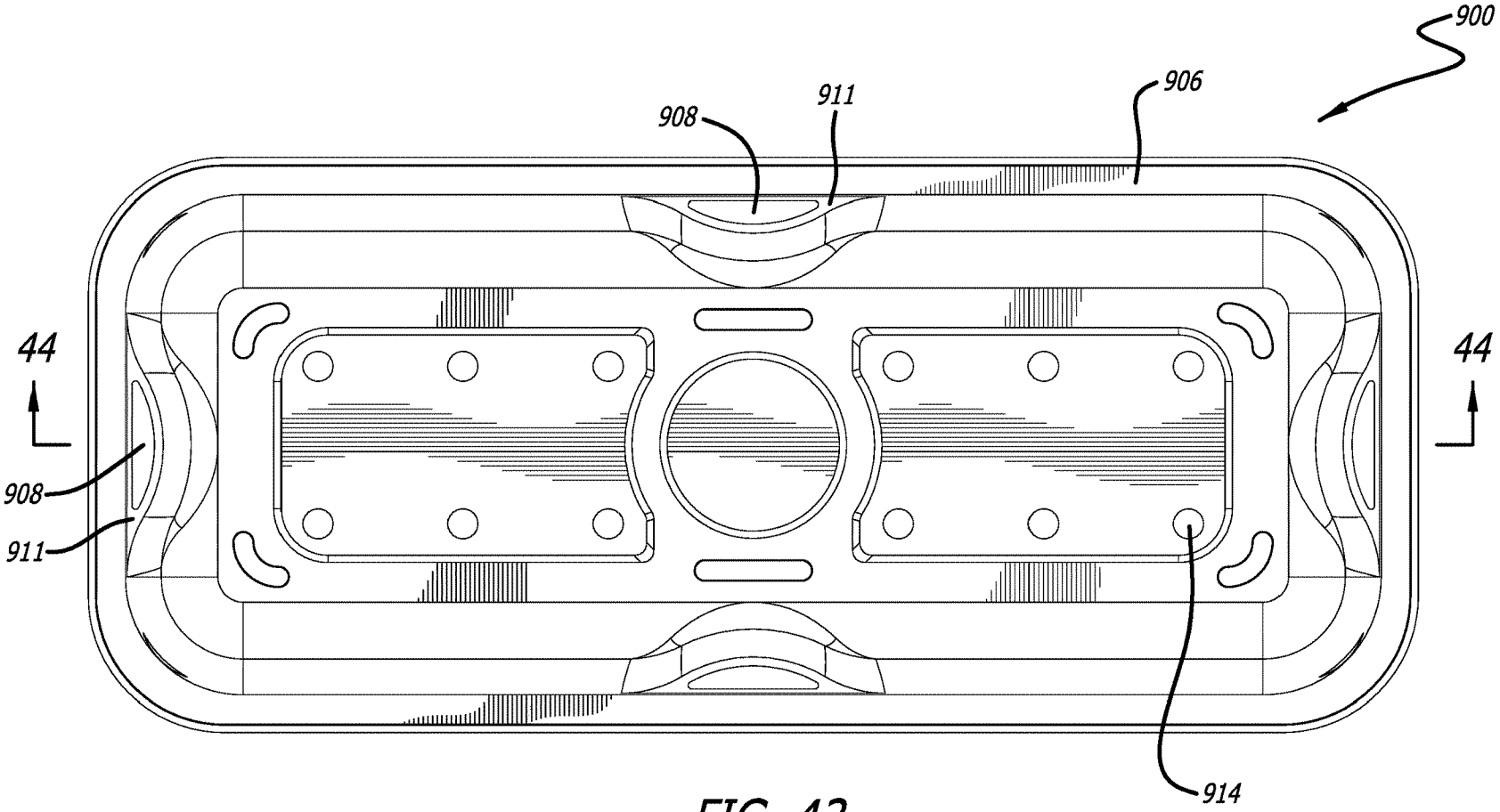
FIG. 43 is a top plan view of the container in accordance with the ninth embodiment of the present invention.
Figure 44:
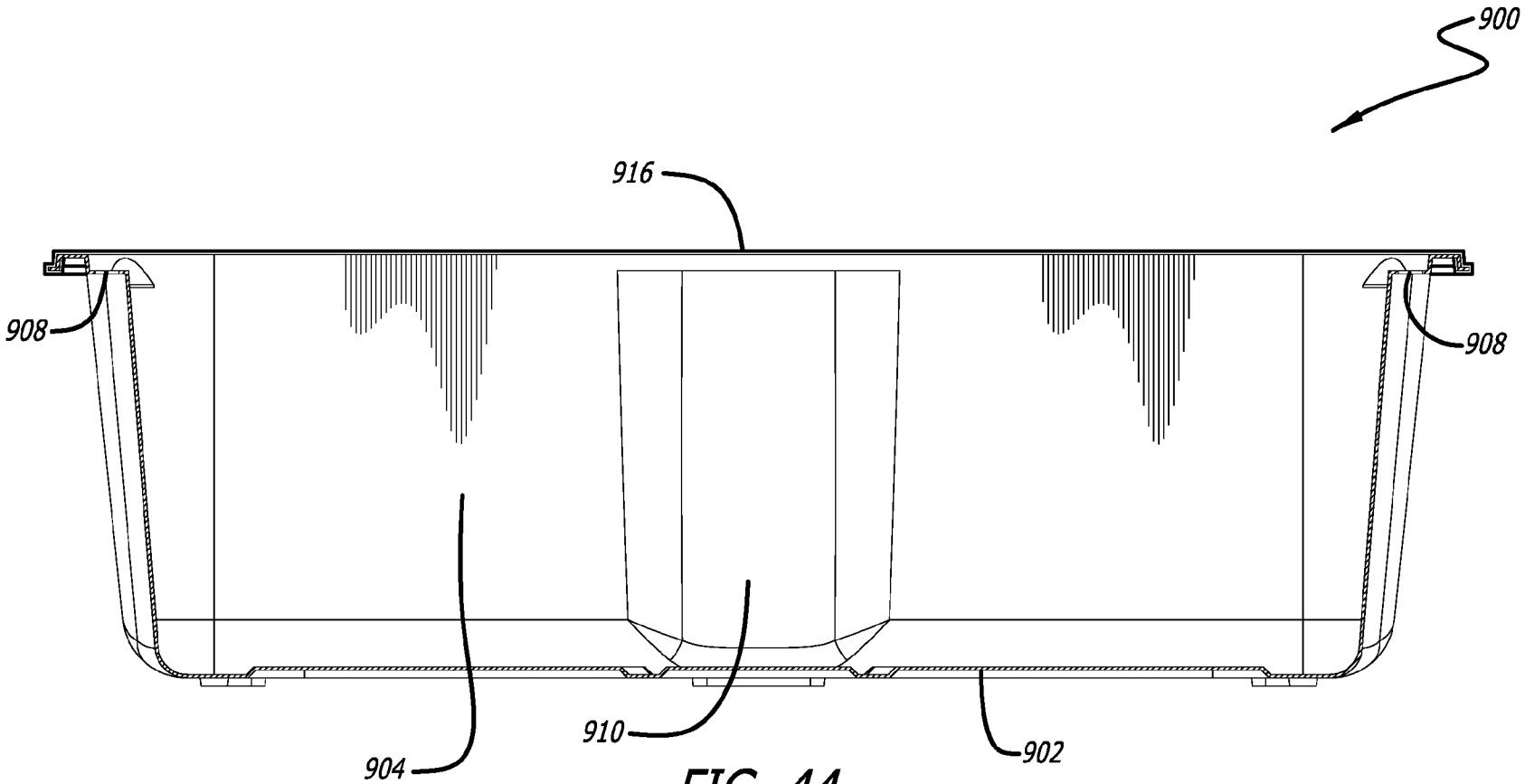
FIG. 44 is a cross-sectional view of the enclosed container sealed with a film taken along line 44-44 of the ninth embodiment of the present invention of FIG. 43.
Figure 45:
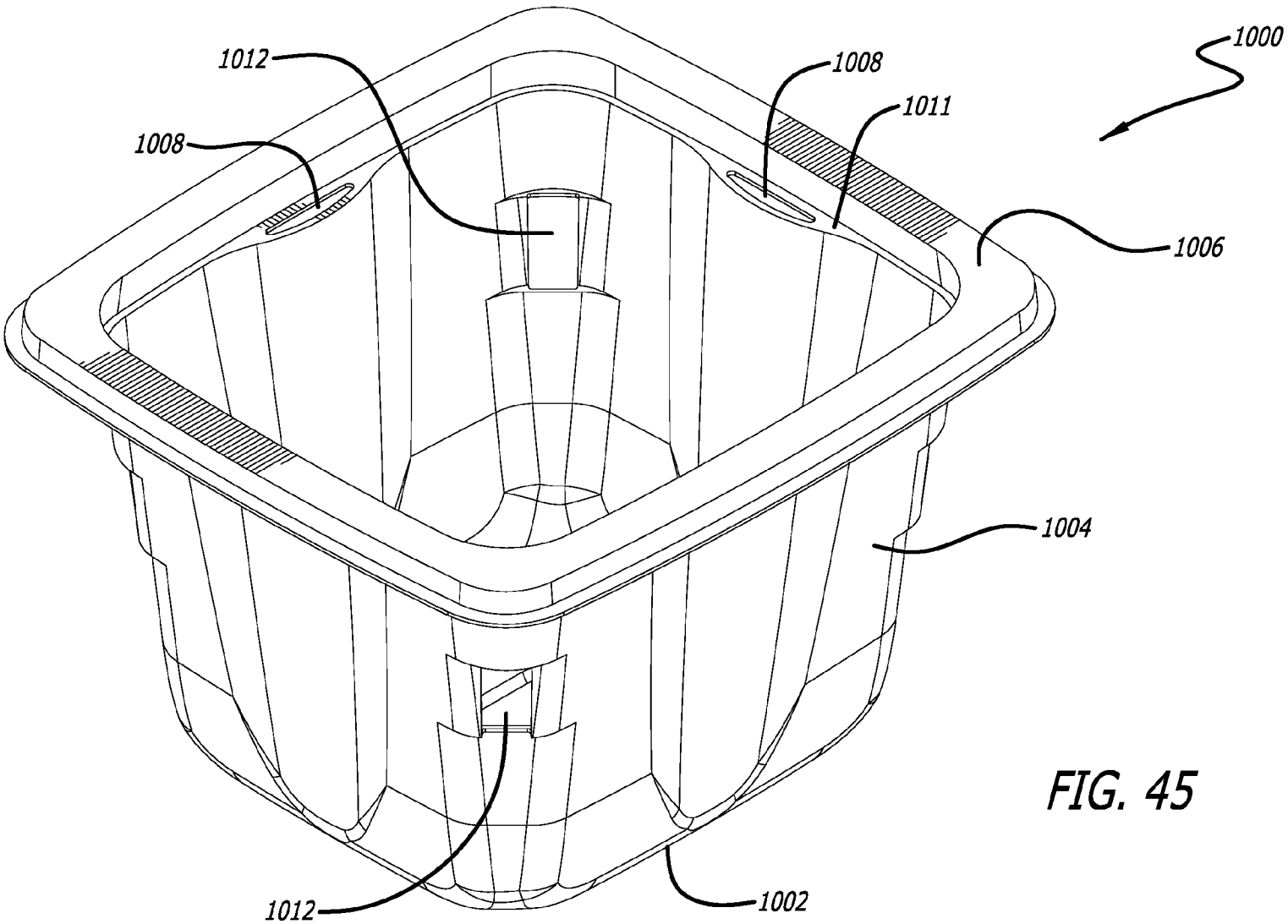
FIG. 45 is a perspective view of the container in accordance with a tenth embodiment of the present invention.
Figure 46:
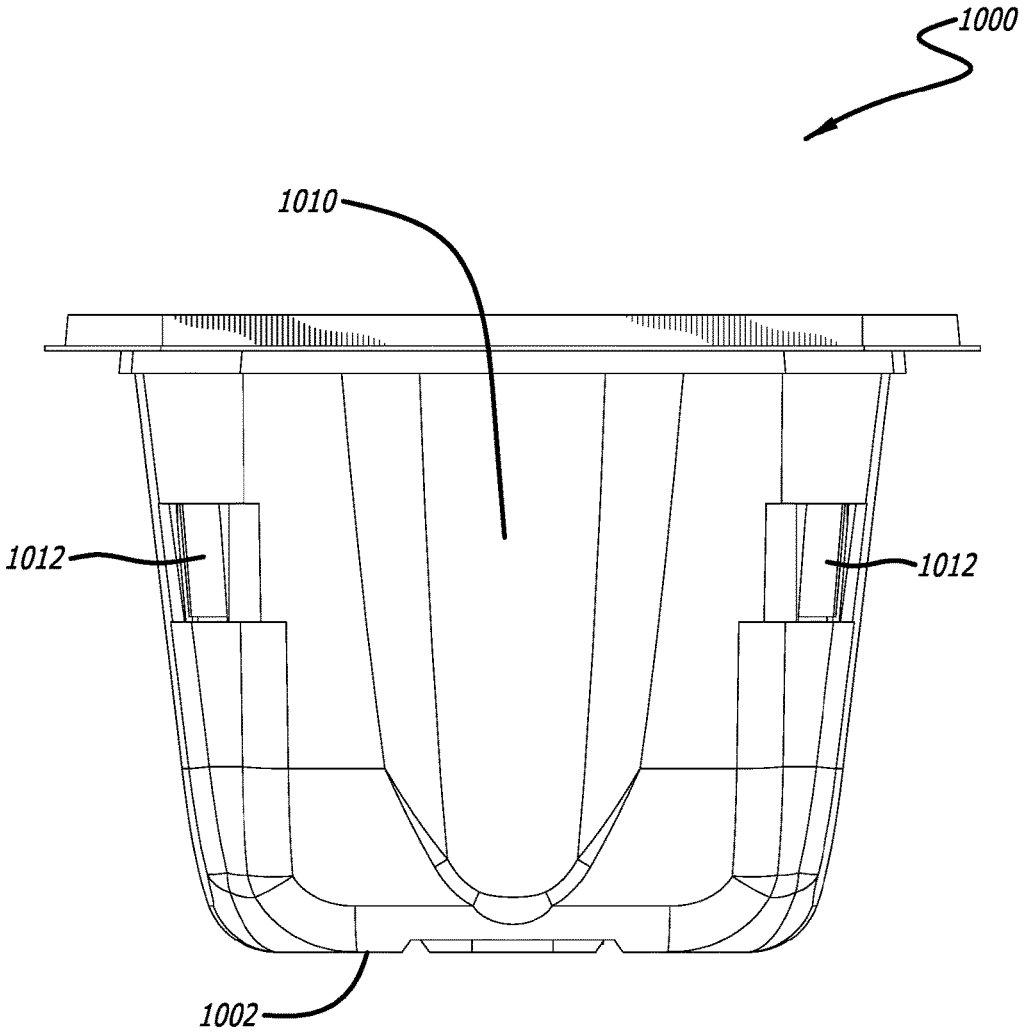
FIG. 46 is a front elevational view of the container in accordance with the tenth embodiment of the present invention.
Figure 47:
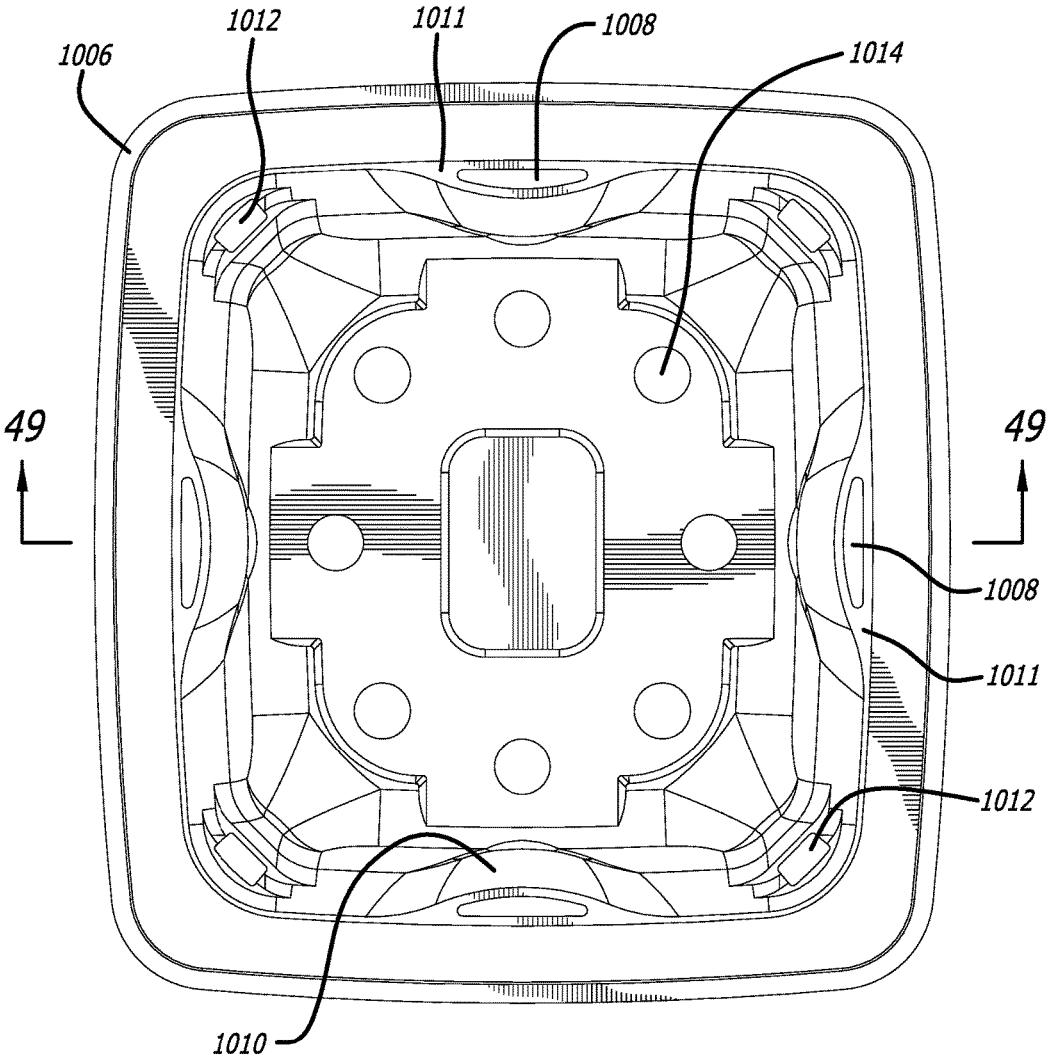
FIG. 47 is a top plan view of the container in accordance with the tenth embodiment of the present invention.
Figure 48:
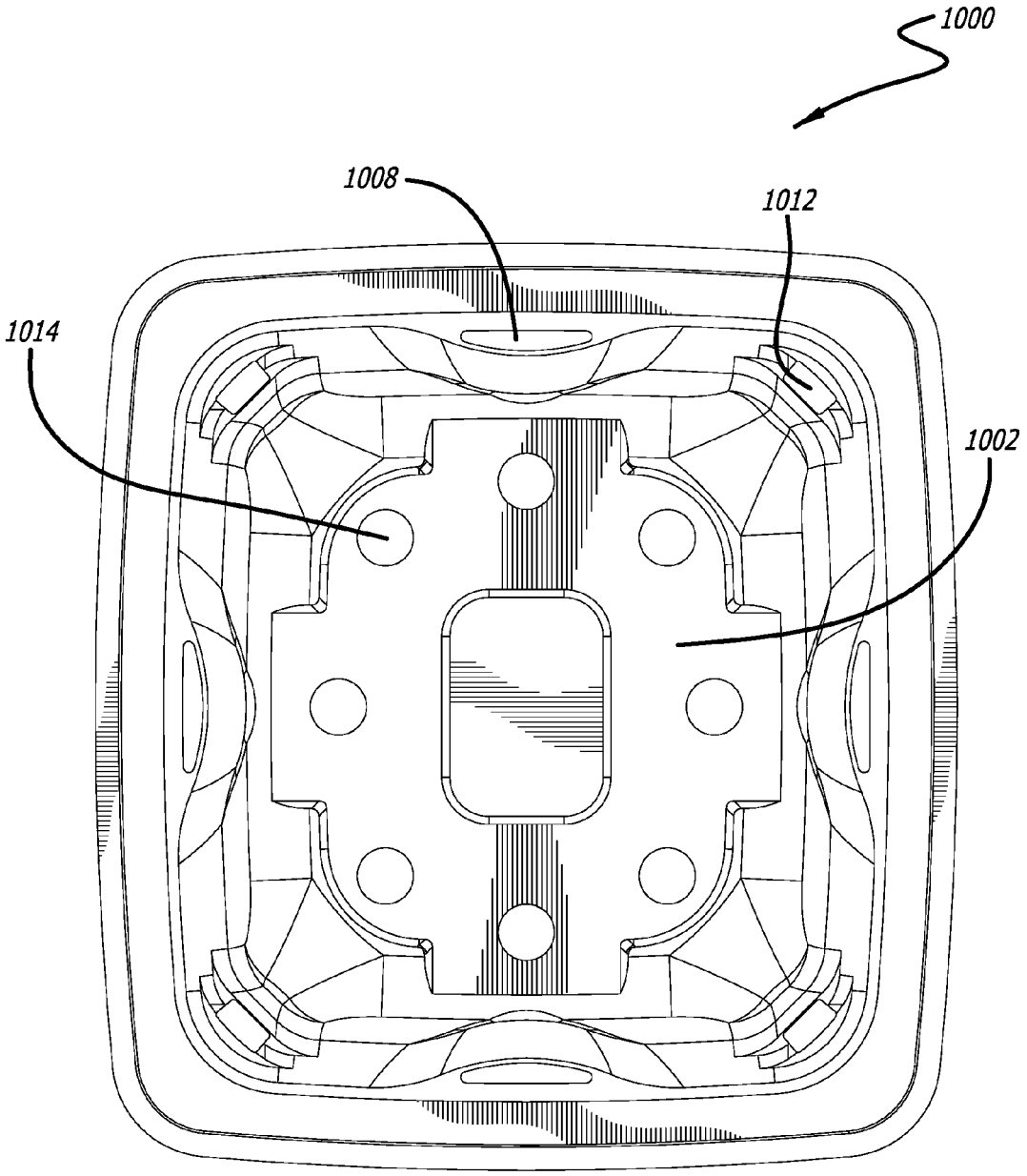
FIG. 48 is a bottom plan view of the container in accordance with the tenth embodiment of the present invention.
Figure 49:
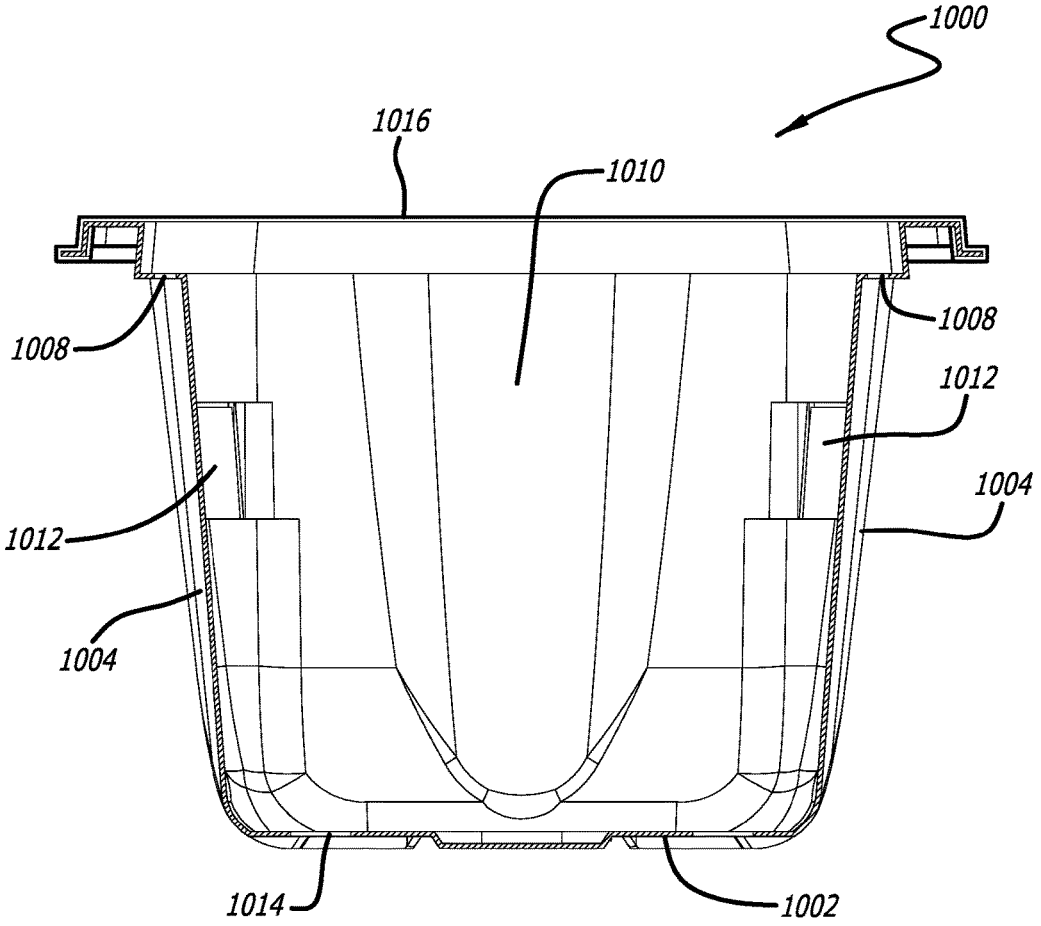
FIG. 49 is a cross-sectional view of the enclosed container sealed with a film taken along line 49-49 of the tenth embodiment of the present invention of FIG. 47.

As shown in FIGS. 12-15, similar to the second embodiment of the present invention, referring to FIGS. 13-15, ventilated container for produce 300 has a generally square configuration, except the different height. Container 300 has a length and width of approximately 7.5 inches and a height of approximately 3.5 inches.

As shown in FIGS. 16-20, in accordance with a third embodiment of the present invention, ventilated container for produce 400 has a generally square configuration. Bottom 402 includes a plurality of integrally formed, inwardly protruding ribs 420. The ribs 420 can stiffen the base and can elevate produce from liquid within the container 400. Furthermore, bottom 402 with ribs 420, compared to a container having a typically flat bottom, can give container stability and make stacking easier.

As shown in FIGS. 21-26, alternatively, ventilated container for produce 500 has a generally rectangular configuration, having a length of approximately 14.55 inches, a width of approximately 7.90 inches, and a height of 3.08 inches. Ventilated container for produce 500 includes a first sidewall 504 having one ventilation opening 508 located proximate rim 506 of container 500 and a second sidewall 504' having two ventilation openings 508 located proximate rim 506 of container 500. Bottom 502 has a plurality of outwardly extending platforms 530. Each platform 530 can have a plurality of apertures 514 to provide drainage of liquid from container 500 and to allow air to flow. Platforms 530 also can give container stability and make stacking easier.

As shown in FIGS. 27-30, similar to the fifth embodiment of the present invention, ventilated container for produce 600 has a generally rectangular configuration, except the different height.

Referring to FIGS. 31-35, another preferred embodiment of ventilated container for produce 700 has a generally rectangular configuration. Bottom 702 has three platforms 730 with a plurality of apertures 714 formed thereon to provide drainage of liquid from container 700 and to allow air to flow.

As shown in FIGS. 36-39, similar to the seventh embodiment of the present invention, ventilated container for produce 800 has a generally rectangular configuration, except the different height.

As shown in FIGS. 40-44, similar to the seventh embodiment of the present invention, ventilated container for produce 900 has a generally rectangular configuration, except the different width.

Referring to FIGS. 45-49, alternatively, ventilated container for produce 1000 has a square configuration.

The invention claimed is:

1. A container for holding produce with ventilation for ethylene gas emitted from the produce within the container, the container comprising:

a bottom portion having a perimeter;

at least four sidewall portions extending upwardly from the bottom portion, each of the sidewall portions including a first side portion, a second side portion, an upper portion, a lower portion, and being oriented substantially along a different plane, the lower portions of each of the sidewall portions being attached to the bottom portion proximate the perimeter thereof, the first side portion of a first of the sidewall portions being attached to the second side portion of a second of the sidewall portions, the first side portion of the second of the sidewall portions being attached to the second side portion of a third of the sidewall portions, the first side portion of the third of the sidewall portions being attached to the second side portion of a fourth of the sidewall portions, and the first side portion of the fourth of the sidewall portions being attached to the second side portion of the first of the sidewall portions, the first of the sidewall portions being oriented substantially along a first plane, the second of the sidewall portions being oriented substantially along a second plane, the third of the sidewall portions being oriented substantially along a third plane, and the fourth of the sidewall portions being oriented substantially along a fourth plane, the bottom portion and the sidewall portions defining a cavity for holding the produce therein;

a rim portion attached to the upper portions of each of the sidewall portions, the rim portion including an upper surface, a lower surface, an outer edge portion, and an inner edge portion, the upper surface being oriented away from the bottom portion, the upper surface being uninterrupted along a portion thereof between the outer edge portion and the inner edge portion, the upper surface being oriented substantially along a fifth plane, the fifth plane being transverse to the first, second, third, and fourth planes; and a cover for engaging the upper surface of the rim portion for enclosing the cavity formed by the bottom portion and the sidewall portions;

wherein the upper portion of at least one of the sidewall portions includes an indentation proximate the rim portion and extending into a portion of the cavity, the indentation including a first surface proximate and adjacent to the rim portion, the first surface extending substantially along a sixth plane, the sixth plane being transverse to the first, second, third, and fourth planes, the first surface including an aperture therethrough proximate the rim portion, the aperture being sized and configured such that a majority of the first surface is open, the aperture affording fluid communication between the exterior of the container and the cavity when the cover is engaged to the upper surface of the rim portion, the aperture being proximate to the rim portion provides an exit for the flow of rising ethylene gas near the top of the container to minimize the amount of ethylene gas within the container naturally emitted from the produce held in the container.

2. The container of claim 1, wherein at least a portion of the first surface of the indentation is oriented away from the bottom portion.

3. The container of claim 1, wherein at least a portion of the first surface of the indentation is disposed inwardly relative to the inner edge portion of the rim portion.

4. The container of claim 1, wherein the first surface of the indentation is positioned below the upper surface of the rim.

5. The container of claim 1, wherein the aperture is elongate.

6. The container of claim 1, wherein the aperture is quarter moon-shaped.

7. The container of claim 1, wherein the first surface of the indentation includes a single aperture.

8. The container of claim 1, wherein the aperture is approximately 1 inch (25.4mm) long and approximately 0.2 inches (5 mm) wide.

9. The container of claim 1, where the container includes at least one opening in a corner formed at the juncture of at least two of the sidewalls.

10. The container of claim 1, wherein the indentation has a curved portion extending inwardly of the sidewalls, the curved portion includes soft geometrical edges configured to limit potential damage to the produce within the container.

11. A container for holding produce with ventilation for ethylene gas emitted from the produce within the container, the container comprising:

a bottom portion having a perimeter;

at least four sidewall portions extending upwardly from the bottom portion, each of the sidewall portions including a first side portion, a second side portion, an upper portion, a lower portion, and being oriented substantially along a different plane, the lower portions of each of the sidewall portions being attached to the bottom portion proximate the perimeter thereof, a first of the sidewall portions being attached to a second of the sidewall portions, the second of the sidewall portions being attached to a third of the sidewall portions, the third of the sidewall portions being attached to a fourth of the sidewall portions, and the fourth of the sidewall portions being attached to the first of the sidewall portions, the bottom portion and the sidewall portions defining a cavity for holding the produce therein;

a rim portion attached to the upper portions of each of the sidewall portions, the rim portion including an upper surface, a lower surface, an outer edge portion, and an inner edge portion, the upper surface being oriented away from the bottom portion, the upper surface being uninterrupted along a portion thereof between the outer edge portion and the inner edge portion; and a cover for engaging the upper surface of the rim portion for enclosing the cavity formed by the bottom portion and the sidewall portions;

wherein the upper portion of at least one of the sidewall portions includes an indentation proximate the rim portion and extending into a portion of the cavity, the indentation including a first surface proximate and adjacent to the rim portion, the first surface extending substantially along a fifth plane, the fifth plane being transverse to a portion of one of the first, second, third, and fourth of the sidewall portions, the first surface including an aperture therethrough proximate the rim portion, the aperture being sized and configured such that a majority of the first surface is open, the aperture affording fluid communication between the exterior of the container and the cavity when the cover is engaged to the upper surface of the rim portion, the aperture being proximate to the rim portion provides an exit for the flow of rising ethylene gas near the top of the container to minimize the amount of ethylene gas within the container naturally emitted from the produce held in the container.

12. The container of claim 11, wherein at least a portion of the first surface of the indentation is oriented away from the bottom portion.

13. The container of claim 11, wherein at least a portion of the first surface of the indentation is disposed inwardly relative to the inner edge portion of the rim portion.

14. The container of claim 11, wherein the first surface of the indentation is positioned below the upper surface of the rim.

15. A container for holding produce with ventilation for ethylene qas emitted from the produce within the container, the container comprising:

a bottom portion having a perimeter;

at least four sidewall portions extending upwardly from the bottom portion, each of the sidewall portions including a first side portion, a second side portion, an upper portion, and a lower portion, the lower portions of each of the sidewall portions being attached to the bottom portion proximate the perimeter thereof, a first of the sidewall portions being attached to a second of the sidewall portions, the second of the sidewall portions being attached to a third of the sidewall portions, the third of the sidewall portions being attached to a fourth of the sidewall portions, and the fourth of the sidewall portions being attached to the first of the sidewall portions, the bottom portion and the sidewall portions defining a cavity for holding the produce therein; and a rim portion attached to the upper portions of each of the sidewall portions, the rim portion including an upper surface, a lower surface, an outer edge portion, and an inner edge portion, the upper surface being oriented away from the bottom portion wherein the upper portion of at least one of the sidewall portions includes an indentation proximate the rim portion and extending into a portion of the cavity, the indentation including a first surface proximate and adjacent to the rim portion, the first surface protruding into the cavity, the first surface including an aperture therethrough proximate the rim portion, the aperture being sized and configured such that a majority of the first surface is open, the aperture affording fluid communication between the exterior of the container and the cavity, the aperture being proximate to the rim portion provides an exit for the flow of rising ethylene gas near the top of the container to minimize the amount of ethylene gas within the container naturally emitted from the produce held in the container.

16. The container of claim 15, wherein the upper surface is uninterrupted along a portion thereof between the outer edge portion and the inner edge portion.

17. The container of claim 15, wherein at least one of the outer edge portion and the inner edge portion of the rim includes a complete perimeter.

18. The container of claim 15, wherein at least a portion of the first surface of the indentation is oriented away from the bottom portion.

19. The container of claim 15, wherein at least a portion of the first surface of the indentation is disposed inwardly relative to the inner edge portion of the rim portion.

20. The container of claim 15, wherein the first surface of the indentation is positioned below the upper surface of the rim.

* * * * *